US012460483B2

(12) United States Patent
Pray et al.

(10) Patent No.: US 12,460,483 B2
(45) Date of Patent: Nov. 4, 2025

(54) APPARATUS AND METHOD FOR ASSEMBLING AND DEPLOYING WHIPSTOCK ASSEMBLY

(71) Applicant: Weatherford Technology Holdings, LLC, Houston, TX (US)

(72) Inventors: Jeffery S. Pray, Shenandoah, TX (US); Albert C. Odell, II, Kingwood, TX (US); Jeffrey E. Toulouse, Houston, TX (US); Ronald G. Schmidt, Tomball, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/582,397

(22) Filed: Feb. 20, 2024

(65) Prior Publication Data

US 2025/0003292 A1 Jan. 2, 2025

Related U.S. Application Data

(60) Provisional application No. 63/524,503, filed on Jun. 30, 2023.

(51) Int. Cl.
*E21B 7/06* (2006.01)
*E21B 19/06* (2006.01)

(52) U.S. Cl.
CPC ..... *E21B 7/061* (2013.01); *E21B 19/06* (2013.01)

(58) Field of Classification Search
CPC ..... E21B 7/061; E21B 19/06; E21B 19/14; E21B 19/146; E21B 3/04
See application file for complete search history.

(56) References Cited

U.S. PATENT DOCUMENTS

| | | | | |
|---|---|---|---|---|
| 6,464,002 | B1 | 10/2002 | Hart et al. | |
| 7,610,965 | B2 * | 11/2009 | Pennison | E21B 19/087 166/380 |
| 9,551,205 | B2 | 1/2017 | Gonzalez et al. | |
| 9,938,777 | B2 | 4/2018 | Sigmar et al. | |
| 10,006,264 | B2 | 6/2018 | Glaser et al. | |
| 10,465,456 | B2 | 11/2019 | Gupta et al. | |

(Continued)

FOREIGN PATENT DOCUMENTS

| | | | |
|---|---|---|---|
| WO | 2021206576 | A1 | 10/2021 |
| WO | 2022167620 | A1 | 8/2022 |

OTHER PUBLICATIONS

Int'l Search Report and Written Opinion in PCT/US2024/022756 dated Jul. 1, 2024, 9-ogs.

*Primary Examiner* — Tara Schimpf
*Assistant Examiner* — Lamia Quaim
(74) *Attorney, Agent, or Firm* — Cabello Hall Zinda, PLLC

(57) ABSTRACT

An apparatus or cradle having top and bottom supports is used to assemble, transport, and deploy a bottom hole assembly. The cradle supports at least a whipstock and mill of the assembly during assembly and transport. At the rig, the assembly and at least the mill support are lifted, and a portion of the assembly is through a rotary table of the rig. The assembly is then supported on the rig by engaging a base of the cradle on the rotary table. A milling tool is connected to the mill of the assembly, and the assembly is disconnected from the at least one support of the cradle. The assembly and the milling tool can then be run through the rotary table for deployment downhole.

20 Claims, 29 Drawing Sheets

(56) References Cited

U.S. PATENT DOCUMENTS

| | | | | |
|---|---|---|---|---|
| 10,704,328 | B2 | 7/2020 | Korf et al. | |
| 10,934,780 | B2 | 3/2021 | Pray et al. | |
| 11,230,886 | B2 | 1/2022 | Taggart et al. | |
| 11,230,907 | B2 | 1/2022 | Shirani et al. | |
| 11,333,004 | B2 | 5/2022 | Taylor, Jr. et al. | |
| 11,519,234 | B2 | 12/2022 | Pray et al. | |
| 11,560,757 | B2 | 1/2023 | Pray et al. | |
| 2005/0161227 | A1* | 7/2005 | Hayes | E21B 19/20 166/380 |
| 2010/0319997 | A1 | 12/2010 | King et al. | |
| 2012/0241144 | A1* | 9/2012 | Bell | E21B 7/061 166/117.5 |
| 2018/0209233 | A1 | 7/2018 | Hulsewe | |
| 2021/0372219 | A1* | 12/2021 | Brown-Kerr | E21B 23/00 |
| 2022/0251939 | A1 | 8/2022 | McHugh et al. | |

* cited by examiner

APPARATUS AND METHOD FOR ASSEMBLING AND DEPLOYING WHIPSTOCK ASSEMBLY

CROSS-REFERENCE TO RELATED APPLICATIONS

This application claims the benefit of U.S. Provisional Appl. No. 63/524,503 filed Jun. 30, 2023, which is incorporated herein by reference in its entirety.

BACKGROUND OF THE DISCLOSURE

It is known in the oil and gas industry to attach a whipstock to a milling tool for deployment into a wellbore. Once the whipstock is anchored in a desired location in the wellbore, the milling tool is separated from the whipstock so a sidetrack can be milled. A shearable attachment or a releasable latch can be used between the whipstock and the milling tool so the milling tool can be separated from the whipstock.

Typically, the whipstock is temporarily assembled off site in a workshop, and integrity tests are initially performed on its hydraulic system. After the temporary assembly for the hydraulic system test, the whipstock components are unconnected for separate transportation to the jobsite. Once at the jobsite, personnel must re-assemble the whipstock before running in hole.

At the rig, crew members inspect the assembly and perform additional integrity tests. The shipping screws are removed, and a predetermined number of shear screws are installed for the packer, the anchor, and any other components of the whipstock.

At this point, the whipstock is picked up at the rig and is lowered through the rotary table using a T-Bar. The milling tool is then picked up at the rig and is connected to the whipstock. As noted, the connection can use either a shearable attachment or a releasable latch. For the shearable attachment, a shear bolt is installed between portions of the milling tool and whipstock and is to a specified torque limit. In contrast, the releasable latch uses a retractable bolt installed on a hydraulic mill release to connect portions of the milling tool and whipstock together.

Continuing with the assembly at the rig, crew members install a hydraulic line to connect from a lead mill to the whipstock so hydraulics can be communicated through the line to actuate the packer and the anchor on the whipstock once downhole. With the milling tool connected to the whipstock and the hydraulic line installed, the bottom hole assembly is then picked up at the rig, and the T-Bar is removed. At this point, the bottom hole assembly is lowered into the well while a crew member places a chalk line on the drill string for orientation with a measurement-while-drilling (MWD) tool.

As can be seen, assembly and deployment of a bottom hole assembly having a whipstock can require several manual steps to be performed on the rig by the crew members. What is needed is a system that simplifies the assembly and deployment of a bottom hole assembly having a whipstock on a rig to reduce the number of crew members and assembly steps required on the rig floor.

The subject matter of the present disclosure is directed to overcoming, or at least reducing the effects of, one or more of the problems set forth above.

SUMMARY OF THE DISCLOSURE

Some implementations herein relate to a method, which can be performed at a rotary table of a rig. For example, the method may include lifting a whipstock assembly at the rig, wherein the whipstock assembly has a whipstock and a lead mill connected together by a releasable operational connection. The method may also include running the whipstock assembly at least partially through the rotary table of the rig. The method may furthermore include supporting the whipstock assembly at the rotary table of the rig using an apparatus by: supporting portions of the whipstock and the lead mill with a support member of the apparatus, supporting the support member on a base member of the cradle, and supporting the base member at the rotary table. The method may in addition include connecting a milling assembly to the lead mill of the whipstock assembly. The method may moreover include unsupporting the lead mill and the whipstock assembly from the support member. The method may also include running the whipstock assembly and the milling assembly through the rotary table.

The described implementations may also include one or more of the following features. Lifting the whipstock assembly and running the whipstock assembly at least partially through the rotary table of the rig in the method may include engaging an elevator of the rig on a lifting sub connected to the lead mill on the whipstock assembly; and connecting the milling assembly to the lead mill of the whipstock assembly in the method may include removing the lifting sub and threading a coupling of the milling assembly to the lead mill. Supporting the base member of the apparatus at the rotary table in the method may include engaging drive pins on the base member in slots of a drive bushing of the rotary table.

In the method, the apparatus may include a body support member configured to supporting a body of the whipstock and being removably connected to the base member. The method can involve, before lifting, disconnecting the body support member from the apparatus, and removing the body support member from supporting the body of the whipstock.

The steps of lifting the whipstock assembly, running the whipstock assembly at least partially through the rotary table of the rig, supporting the support member on the base member, and supporting the base member at the rotary table in the method may include: lifting the whipstock assembly having the apparatus supported thereon, the apparatus having the support member connected to the base member; running the whipstock assembly at least partially through the rotary table of the rig; and landing the base member of the apparatus at the rotary table.

The steps of lifting the whipstock assembly, running the whipstock assembly at least partially through the rotary table of the rig, supporting the support member on the base member, and supporting the base member at the rotary table in the method may include: lifting the whipstock assembly having the support member of the apparatus supported thereon; separately placing the base member at the rotary table; running the whipstock assembly at least partially through the base member placed at the rotary table of the rig; and landing the at least one support member on the base member. Method where landing the support member on the base member may include inserting an end of the support member in a receptacle disposed on the base member.

Supporting the whipstock assembly on the rig using the apparatus in the method may include at least one of: engaging the whipstock on a support shoulder of the support member; engaging the whipstock on a base shoulder of the base member; and engaging the lead mill on a clamp shoulder of a clamp.

Unsupporting the lead mill and the whipstock assembly from the support member in the method may include at least one of: disconnecting the whipstock assembly from the support member; unfastening a first mount on the support member from the whipstock; removing a second mount of the support member from the lead mill; and unclamping a clamp on the second mount of the support member from the lead mill.

The method, before running the whipstock assembly and the milling assembly through the rotary table, may include marking relative orientation of the milling assembly and the whipstock assemblies.

Some implementations herein relate to another method of assembling a bottom hole assembly for transport to a rig. For example, the method may include engaging a portion of a whipstock of the bottom hole assembly on a first mount of a support member of an apparatus. The method may also include engaging a portion of a lead mill of the bottom hole assembly on a second mount of the support member of the apparatus. The method may furthermore include connecting the lead mill to the whipstock with a releasable operational connection. The method may in addition include transporting the bottom hole assembly to the rig for deployment by supporting the whipstock, the lead mill, and the releasable operational connection with the support member.

Some implementations herein relate to an apparatus. The apparatus can be used for transporting a bottom hole assembly to a rig and can be used for supporting the bottom hole assembly at a rotary table of the rig. The bottom hole assembly can have a whipstock and a lead mill, and the lead mill and the whipstock can be connected together by a releasable operational connection. For example, the apparatus may include a support member removably supporting the releasable operational connection between the whipstock and the lead mill. The support member can have first and second mounts. The first mount can be configured to releasably engage a portion of the whipstock, and the second mount can be configured to releasably engage a portion of the lead mill. The apparatus may also include a base member being configured to position at the rotary table of the rig with an end of the whipstock extending through the base member. The base member can be configured to support the support member.

The described implementations may also include one or more of the following features. To releasably engage the portion of the whipstock, the first mount may include at least one of: a first flange configured to affix with a fastener to a side of the whipstock; and a second flange having a shoulder configured to vertically support a complementary shoulder on the whipstock.

To releasably engage the portion of the lead mill, the second mount may include a flange against which a lifting sub of the lead mill positions.

To releasably engage the portion of the lead mill, the second mount may include a clamp configured to clamp about a neck of the lead mill. The clamp may include at least one of: a shoulder to support an upset in the neck of the lead mill, a plurality of set screws threadable against the neck of the lead mill.

The base member may include a shoulder configured to vertically support a complementary shoulder on the whipstock.

The apparatus may include a body member removably connected to the base member, where the support member, the base member, and the body member connected together are configured to support the whipstock, the lead mill, and the releasable operational connection for transporting the bottom hole assembly.

The support member can be releasably connected to the base member as a unit, and the support member and the base member can be connected together as the unit for transporting and supporting the bottom hole assembly. Alternatively, the support member can be a separate component from the base member.

The support member can be used for transporting the bottom hole assembly at the rig, the base member can be supported at the rotary table of the rig, and the support member can be supported by the base member for supporting the bottom hole assembly at the rig.

The base member may include at least one of: a receptacle configured to receive an end of the support member therein for support the bottom hole assembly at the rig; one or more drive pins extending therefrom and configured to engage in slots of a master drive bushing in the rotary table at the rig; and one or more drive pins are removably disposed on the base member or are movable between extended and retracted conditions on the base member.

The foregoing summary is not intended to summarize each potential arrangement or every aspect of the present disclosure.

DETAILED DESCRIPTION OF THE DISCLOSURE

Figure 1:
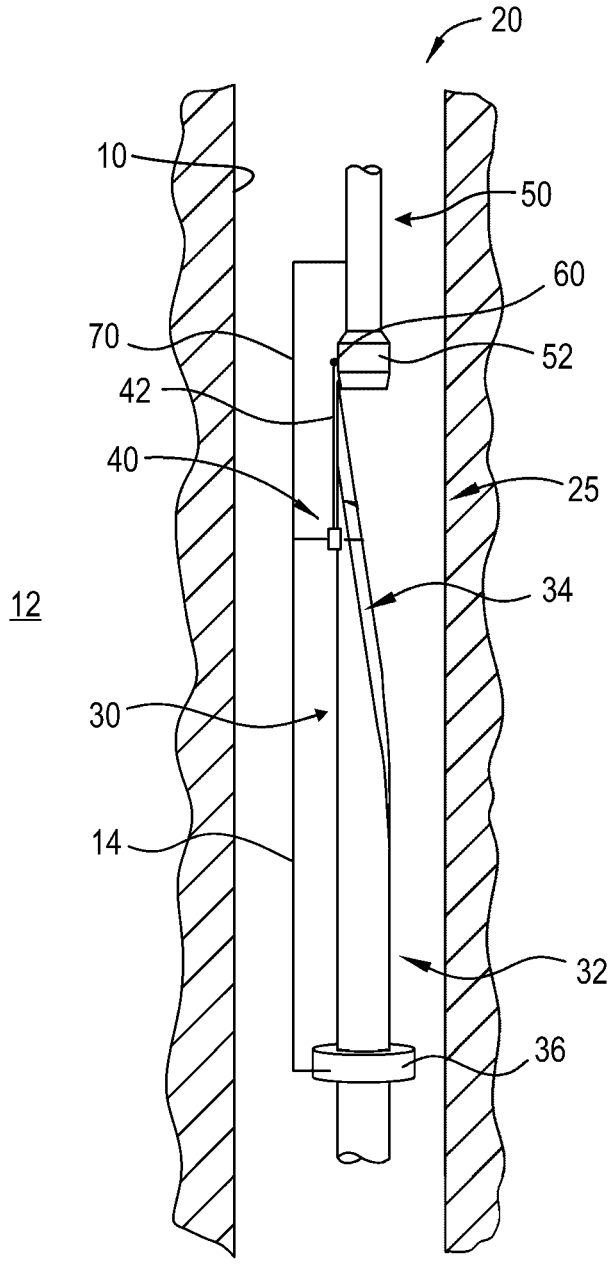
FIG. 1 illustrates a bottom hole assembly disposed in a subsurface formation, the BHA having a milling tool coupled to a whipstock with a latch release mechanism.

FIG. 1 illustrates an example of a bottom hole assembly 20 according to the present disclosure placed in a wellbore 10 within a subsurface formation 12. The bottom hole assembly 20 has a whipstock assembly 30 releasably attached to a downhole tool, such as a milling tool of a milling assembly 50. For example, the whipstock assembly 30 may be attached to the milling assembly 50 by the interaction of a releasable operational connection 25. As will be discussed in greater detail below, the releasable operational connection 25 can include a lock mechanism 60 of the milling assembly 50 with a latch release mechanism 40 of the whipstock assembly 30. Alternatively, the releasable operational connection 25 can use a shear pin or other mechanism.

The bottom hole assembly 20 has a whipstock 32 having a whip or concave 34, which can have an inclined face. A well barrier or anchoring mechanism 36 of the whipstock assembly 30 is used to anchor/set/seal the whipstock assembly 30 in the wellbore 10 so the milling assembly 50 released from the whipstock assembly 30 can be guided along the inclined face of the whip 34 to cut a sidetrack in the wellbore 10.

In general, the anchoring mechanism 36 may include a packer, an inflatable anchor, a slip type anchor, or combinations thereof. The whipstock 32 can be connected to the anchoring mechanism 36, or the anchoring mechanism 36 can be integrated with the whipstock 32.

A fluid communication or pressure line 70 connects from the milling assembly 50 to the whipstock assembly 30. The pressure line 70 can be disposed on, or along at least a portion of the length of the whip 34 and the whipstock 32. The pressure line 70 can be fluidly connected to both the anchoring mechanism 36 and the latch release mechanism 40.

Figure 2A:
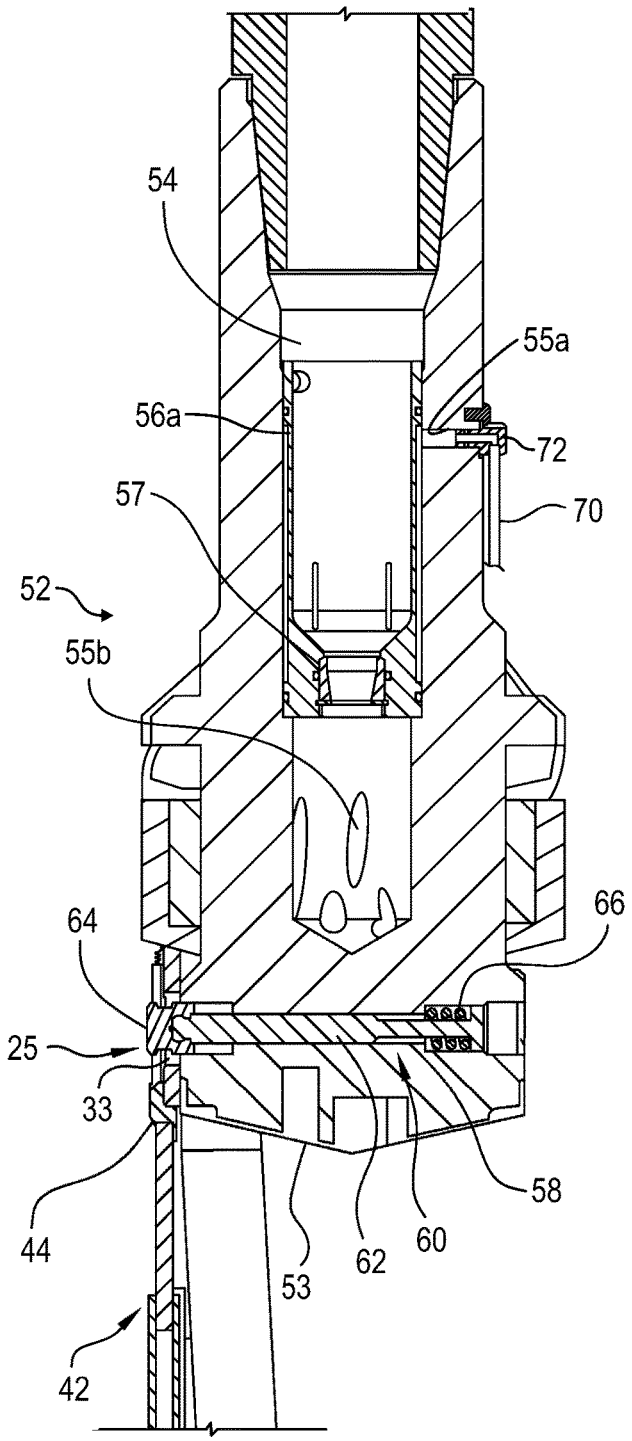
FIG. 2A illustrates a cross-sectional view of the whipstock releasably attached to a lead mill of the milling tool.

FIG. 2A illustrates a detail of a releasable operational connection 25 according to one arrangement of the present disclosure. As noted, the releasable operational connection 25 connects a portion of the whipstock assembly 30 to a portion of the milling assembly 50. Here, the releasable operational connection 25 is hydraulically actuated, including a latch release mechanism 40 on the whipstock assembly 30 and including a lock mechanism 60 on the portion (lead mill 52) of the milling assembly 50. These mechanisms 40, 60 connect together to keep the whipstock assembly 30 connected to the milling assembly 50 during deployment and can be released through hydraulic activation once the whipstock assembly 30 is set downhole.

As shown, the lead mill 52 of the milling assembly 50 has the lock mechanism 60 disposed in the lead mill 52. The lock mechanism 60 includes a locking member 62 disposed on the lead mill 52. In general, the locking member 62 can be shaped as a bolt, pin, a plate, fork, or otherwise shaped to meet manufacturing and/or operational specifications while providing a locking member function and a retraction action. As shown herein, the locking member 62 can be a pin disposed in a bore 58 on the lead mill 52. The bore 58 may be located proximate to the mill face 53.

The locking member 62 can be moved in the bore 58 between an extended position, as shown in FIG. 2, and to a retracted position (not shown). In the extended position, a distal end or latch head 64 of the locking member 62 extends outside of the lead mill 52 and at least partially into an aperture 33 on the distal end of the whipstock 32. In the retracted position, the distal end or latch head 64 of the locking member 62 does not extend outside of the lead mill 52. The locking member 62 is biased toward the retracted position by a biasing mechanism 66, such as a spring.

As shown, the distal end of the locking member 62 can include a latch head 64. When in the extended position, the latch head 64 protrudes beyond the outer diameter of the lead mill 52. The latch head 64 is configured to engage with a latch plate 44 of the latch release mechanism 40 to attach the whipstock assembly 30 to the lead mill 52. The latch head 64 includes a recess for engaging the latch plate 44.

The lead mill 52 and whipstock 32 can be torsionally coupled by torque keys and apertures (not shown) so that a gap is formed between the locking member 62 and the walls of the aperture 33 of the whipstock 32 when torsional loading is applied to the bottom hole assembly (20) from the surface. For example, by providing a gap between the portion of the protruding locking member 62 and the whipstock 32, no torque applied to the lead mill 52 will be transferred to the locking member 62. Torque is transferred from the lead mill 52 to the whipstock 32 via the torque keys. Thus, the lock mechanism 60 is isolated from torsional loads applied to the whipstock 32 by the lead mill 52.

Figure 2B:
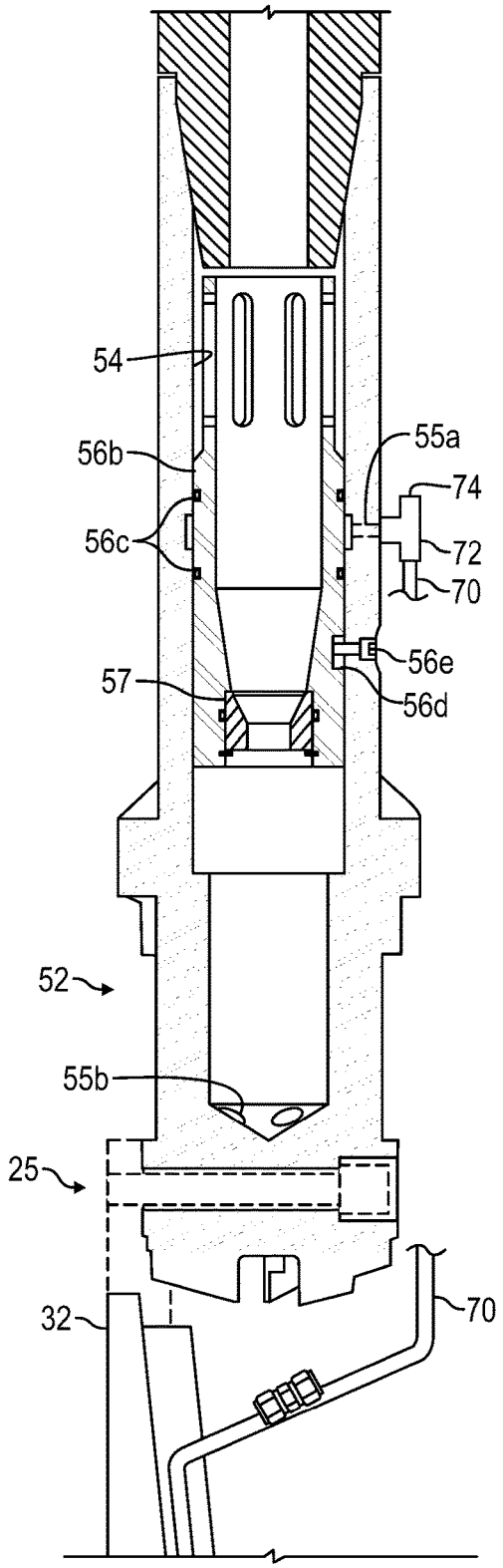
FIG. 2B illustrates another cross-sectional view of the whipstock releasably attached to the lead mill of the milling tool.
Figure 2C:
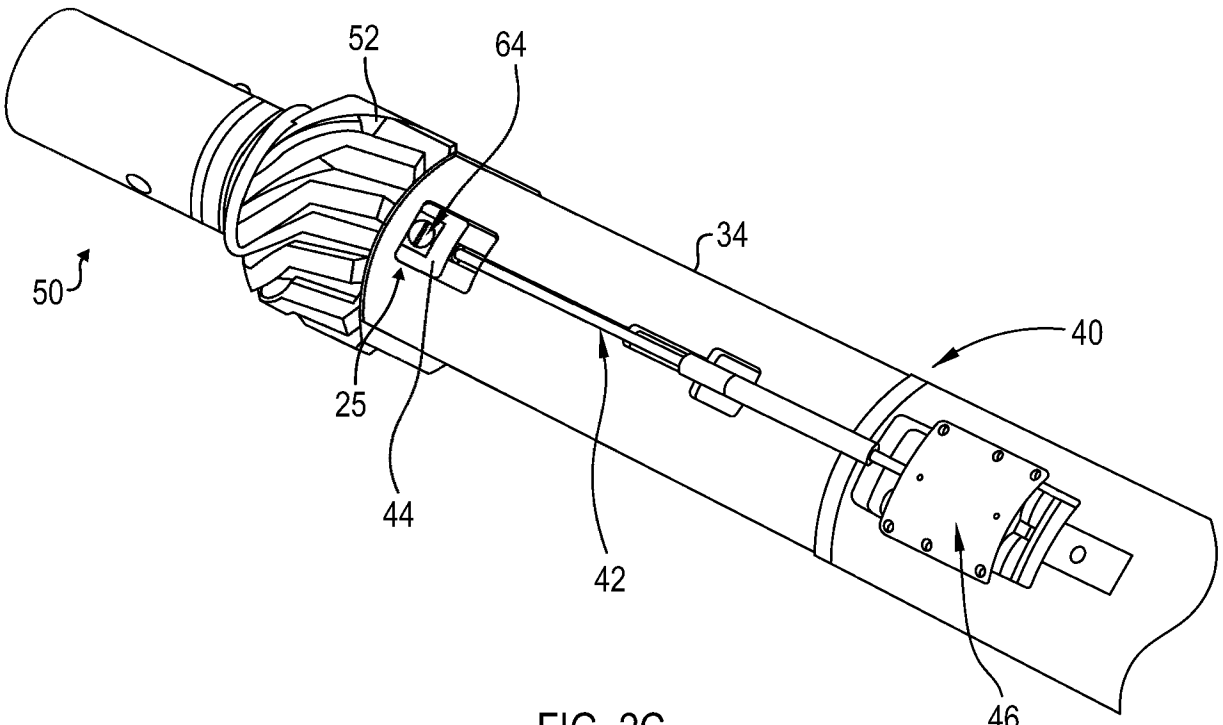
FIG. 2C illustrates an external view of the whipstock releasably attached to the lead mill of the milling tool.

FIG. 2C illustrates another view of the lead mill 52 and the whipstock 32 with the latch plate 44 of the latch release mechanism 40 engaged with the latch head 64 of the lock mechanism (60) to retain the locking member (62) in the extended position. The latch release mechanism 40 includes the latch plate 44, a latch arm 42, and a latch actuator 46 for moving the latch plate 44. The latch actuator 46 is disposed in an aperture of the whipstock 32 and may be affixed to the whipstock 32, such as by a screws or bolts inserted through mounting bores formed in the housing of the latch actuator 46.

The arm 42 has the latch plate 44 attached at one end. The latch plate 44 is configured to engage with the latch head 64 of the locking member (62). In one arrangement, the latch plate 44 can include a two-pronged fork configuration, as shown, that is inserted into the corresponding recess of the latch head 64. Other configurations can be used. As shown, the latch arm 42 is a rod having the latch plate 44 attached at one end. Other configurations can be used.

Further details of a bottom hole assembly as described above is disclosed in U.S. Pat. No. 10,934,780, which is incorporated herein by reference in its entirety. Additionally, further details of hydraulic activation of a releasable connection are described in U.S. Pat. Nos. 7,077,212 and 11,333,004, which are incorporated herein by reference.

Briefly, as shown in FIG. 2A, a sand tube 56*a* is disposed in bore 54 of the lead mill 52 and is secured in place by a set screw (not shown). The sand tube 56*a* includes slits to communicate a change in pressure through an annular area and subsequently into a pressure port 55*a*.

A restriction or nozzle 57 in the inner diameter of the sand tube 56*a* restricts the flow of fluid through the lead mill 52. Fluid can communicate from the pressure port 55*a* through a hydraulic fitting 72 to the pressure line 70. In turn, the communicated pressure in the pressure line 70 can be used for activating the anchoring mechanism (36) on the bottom hole assembly (20) and for triggering hydraulic activation of the release mechanism of the releasable operational connection 25.

Another arrangement shown in FIG. 2B uses a movable sleeve or hydraulic piston 56*b*, at least one temporary connector 56*e*, and a pressure restriction or nozzle 57. The hydraulic piston 56*b* is shown in an inactivated, run-in position in the bore 54. The hydraulic piston 56*b* in an activated position in the bore 54 has its downhole end adjacent the downhole shoulder, and the moved hydraulic piston 56*b* exposes the pressure port 55*a* to the fluid flow in the bore 54.

The restriction 57 creates back-pressure to stroke the hydraulic piston 56*b* open relative to the pressure port 55*a*, which allows the fluid flow to reach the pressure line 70 for setting the packer and/or other tools below the whipstock assembly 30. After opening, the fluid flow can continue to pass through the hydraulic piston 56*b* and the restriction 57 to the ports or mill outlets 55*b* in the lead mill 52.

A temporary connector 56*e* is used to hold the hydraulic piston 56*b* in the unactive position.

Again, the communicated pressure in the pressure line 70 can be used for activating the anchoring mechanism (36) on the bottom hole assembly (20) and for triggering hydraulic activation of the release mechanism of the releasable operational connection 25. Because the movable hydraulic piston 56*b* in the closed condition isolates the pressure line 70 from the bore 54 of the lead mill 52, hydraulic testing can be performed on the assembly. For example, the hydraulic fitting 72 for the pressure port 55*a* and pressure line 70 can include an additional port 74 to allow for fluid filling of the assembly and pressure testing. The port 74 can be plugged after testing to seal the hydraulic system.

Figure 3A:
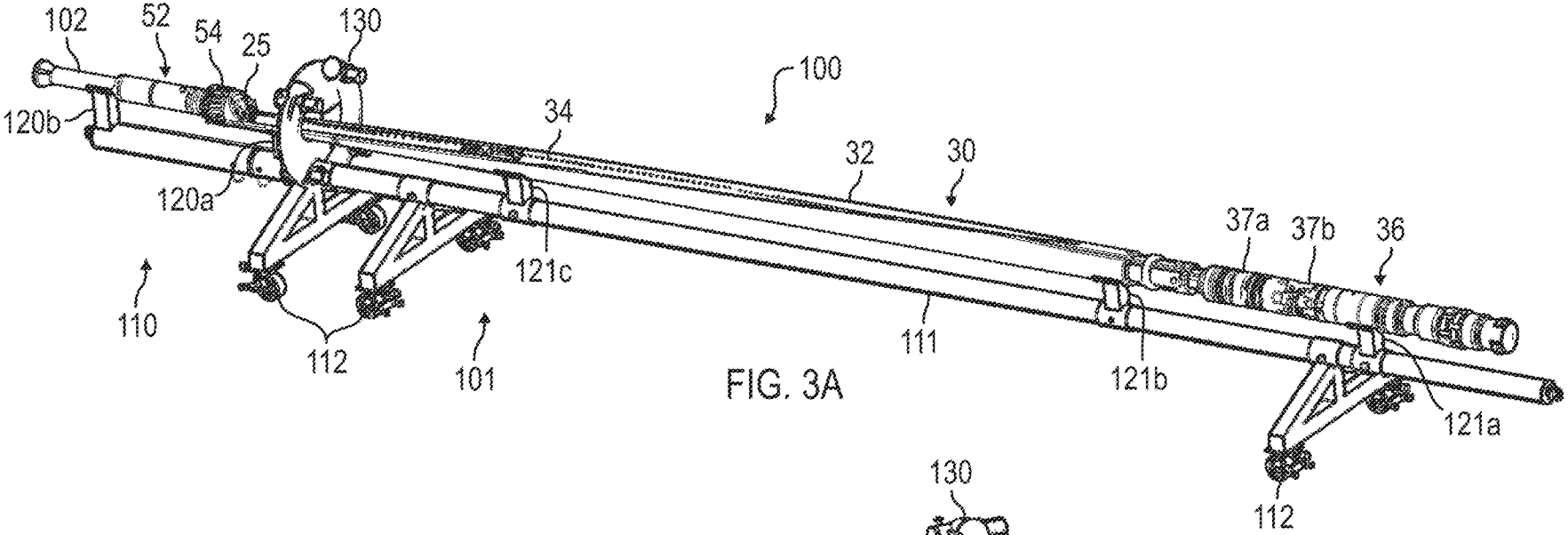
FIG. 3A illustrates a perspective view of an apparatus according to the present disclosure to assemble, transport, and deploy components of a bottom hole assembly.
Figure 3B:
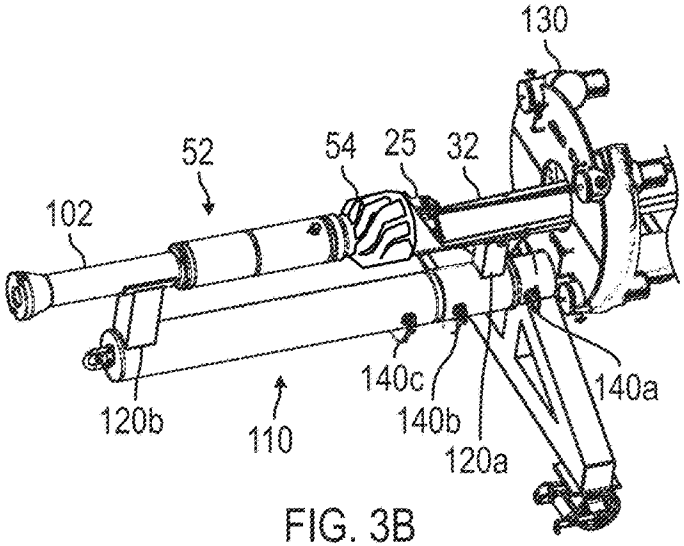
FIG. 3B illustrates a detailed perspective view of a portion of the apparatus.

Having an understanding of the bottom hole assembly, discussion now turns to an apparatus used to assemble, transport, and deploy the bottom hole assembly at a rig. FIG. 3A illustrates a perspective view of an apparatus or carrier 100 according to the present disclosure to assemble, transport, and deploy components of a bottom hole assembly. FIG. 3B illustrates a detailed perspective view of a portion of the apparatus 100.

The apparatus 100 includes a cradle 101 that is used for assembling and testing components of a bottom hole assembly having the lead mill 52 and the whipstock assembly 30 (having a whipstock 32, an anchoring mechanism 36, etc.) in a shop environment. The cradle 101 can be modular. The cradle 101 along with the assembled equipment can be transported together to a jobsite and can then be used by crew members on the rig to handle and deploy the bottom hole assembly downhole. To facilitate operation, the modular cradle 101 can use rigid bolted connections and can use quick release pins (which can be color coded for crew members). The cradle 101 can also include integrated lifting/handling points.

The modular cradle 101 includes a first support member 110 and a second support member. The first support member is a mill, end, top, or upper support member 110, and the second support member is a base member or landing 130. The cradle 101 can further include an additional (body, bottom, or lower) support member 111. The body support member 111 extends along the length of the whipstock 32 and the anchoring mechanism 36 and supports the whipstock 32 and the anchoring mechanism 36 at multiple points.

The body support member 111 can removably connect to the base member 130. As shown, the body support member 111 can be a bar having mounts 121*a-c* disposed thereon. The mounts 121*a-c* can be adjustably positioned along the length of the body support 111 to accommodate the whipstock 32 and the anchoring mechanism 36, and the mounts 121*a-c* can be affixed at desired positions. Flanges on the mounts 121*a-c* can support portions of the whipstock 32 and the anchoring mechanism 36. Preferably, straps (not shown) can be used for most of the mounts 121*a-c* to hold the whipstock 32 and the anchoring mechanism 36 to the flanges on the mounts 121*a-c*.

The mill support member 110 is connected to and supports the connection of the lead mill 52 to the whip 34 of the whipstock 32. In one arrangement, the mill support member 110 is a separate component from the base member 130. In this instance, the mill support member 110 supports the connection of the lead mill 52 to the whipstock 32, while the base member 130 may or may not engage the whipstock 32 and support the whipstock assembly 30.

In another arrangement as shown more particularly here, the mill support member 110 is removably connected to the base member 130 so the two members 110 and 130 can be used as a unit. The mill support member 110 also includes a bar having mounts 120*a-b*. The mounts 120*a-b* may or may not be adjustable on the support member 110. In any event, different sized support members 110 can be used for different implementations.

A first or whip mount 120*a* is configured to releasably engage a portion of the whipstock 32, and a second or mill mount 120*b* is configured to releasably engage a portion of the lead mill 52. For example and as discussed in more detail below, the whip mount 120*a* has a flange that removably affixes to the whipstock 32. For instance, the flange on the whip mount 120*a* on the mill support member 110 can affix with one or more fasteners or bolts to the end of the whip 34, which can have preconfigured mounting holes.

The lead mill 52 is preconnected to the whipstock assembly 30 with a releasable operational connection 25 (e.g., a shearable connector or a hydraulically releasable latch mechanism). The mill mount 120*b* can support an end of the lead mill 52, such as by supporting a lifting sub 102 attached to the lead mill 52. A flange of this mill mount 120*b* can affix with a fastener, or a strap or other mechanism can be used.

In this arrangement, the mill support member 110 is removably connected to the base member 130 through which the end of the whip 34 extends. The base member 130 is used during deployment of the bottom hole assembly as discussed below. Removable support legs 112 can be attached to the support members 110, 111 of the cradle 101. These support legs 112 can be removed from cradle 101 for shipping.

Figure 4A:
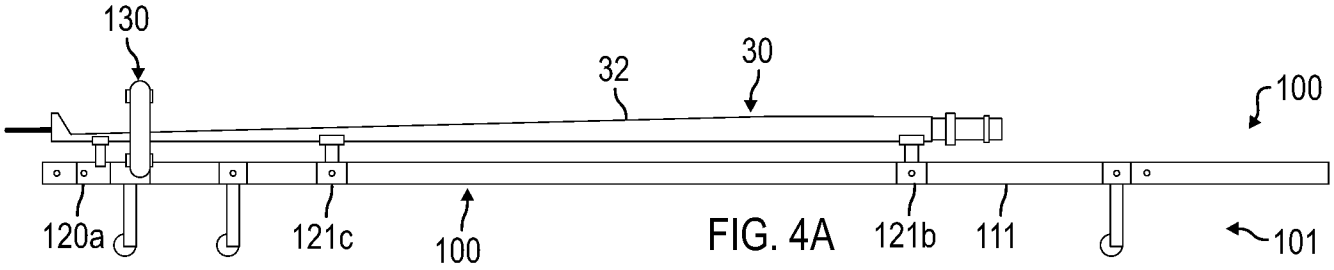
FIGS. 4A-4C illustrate the disclosed apparatus during assembly steps.
Figure 4B:
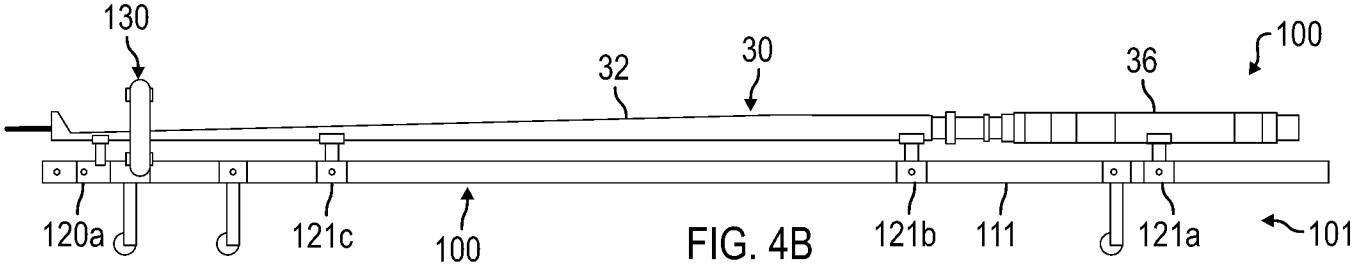
Figure 4C:
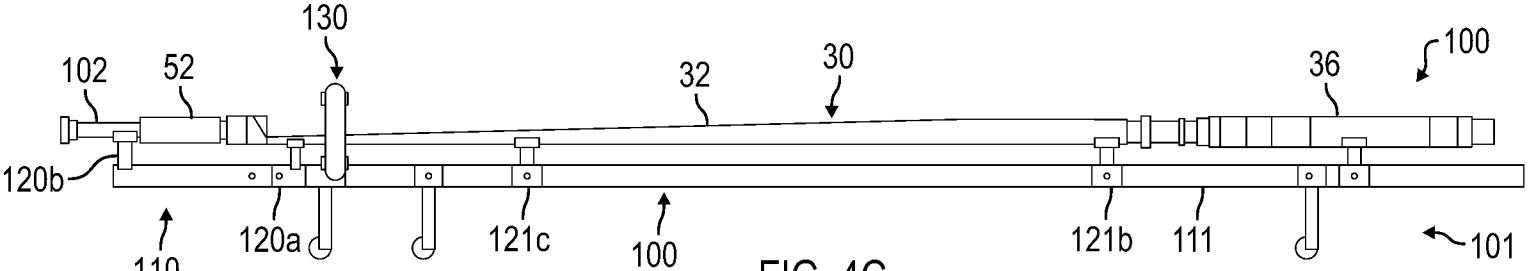

Discussion now turns to steps for assembling components of a whipstock assembly 30 on the disclosed apparatus 100. FIGS. 4A-4C illustrate the disclosed apparatus 100 during assembly steps. The whipstock 32, the anchoring mechanism 36, and the lead mill 52 are initially assembled in the modular cradle 101 offsite, such as at a workshop.

As shown in FIG. 4A, the base member 130 can be connected to an end of the body support member 111. As noted, the connection can include telescopic joints mating with one another, and removable clevis pins can affix the ends together. The whipstock 32 for the whipstock assembly 30 is mounted on the body support member 111 of the cradle 101. The end of the whip 34 is positioned through the base member 130, and the end of the whip 34 is mounted to the flange of the whip mount 120*a*. As shown in FIG. 4B, the anchoring mechanism 36 is then connected to the end of the whipstock 32 and is affixed to one or more mounts 121*a* on the body support member 111.

As shown in FIG. 4C, the support member 110 is connected to the base member 130. Again, the connection can include telescopic joints mating with one another, and removable clevis pins can affix the ends together. A lifting sub 102 is connected to an upper end of the lead mill 52 for the milling assembly, and the lifting sub 102 is supported on the mill mount 120*b* of the support member.

The lead mill 52 is then connected to the whipstock 32 installed in the cradle 101. As noted, the releasable operational connection 25 to the whipstock 32 can use a shear bolt or can use a retractable bolt and hydraulically operated latch. A hydraulic line and steel shipping bolts are installed.

At this point, operators perform pressure integrity testing of the hydraulic system. Once testing is complete, the hydraulic system is closed with temporary plugs. Other parts of the milling assembly (not shown) lacking the lead mill 52 can be assembled separately and can have a lifting sub.

The whipstock assembly 30 is strapped to the mounts 120*a-b*, 121*a-c*, and the cradle 101 and assembled equipment (30, 36, 52) can be loaded for shipment to a rig. The whipstock assembly 30 can be shipped with support member 110, the body support member 111, and the base member 130 connected together as shown here. Alternatively, the whipstock assembly 30 can be shipped with only the support member 110 connected to the whipstock assembly 30 to facilitate rapid deployment at jobsite. The base member 130 can also be shipped connected to the support member 110.

Figure 5A:
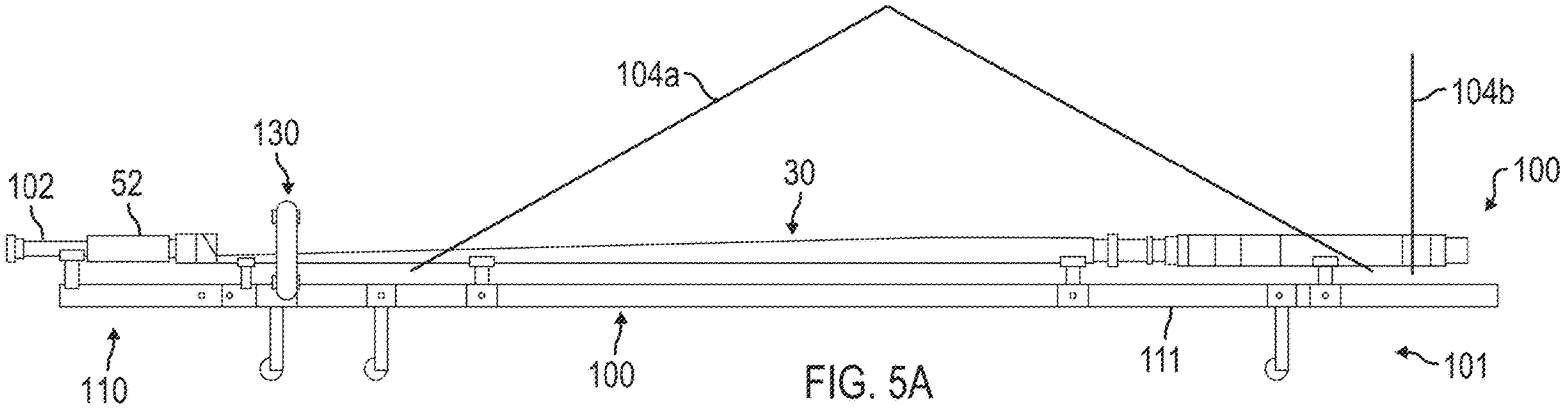
FIGS. 5A-5F illustrate the disclosed apparatus during first deployment steps.
Figure 5B:
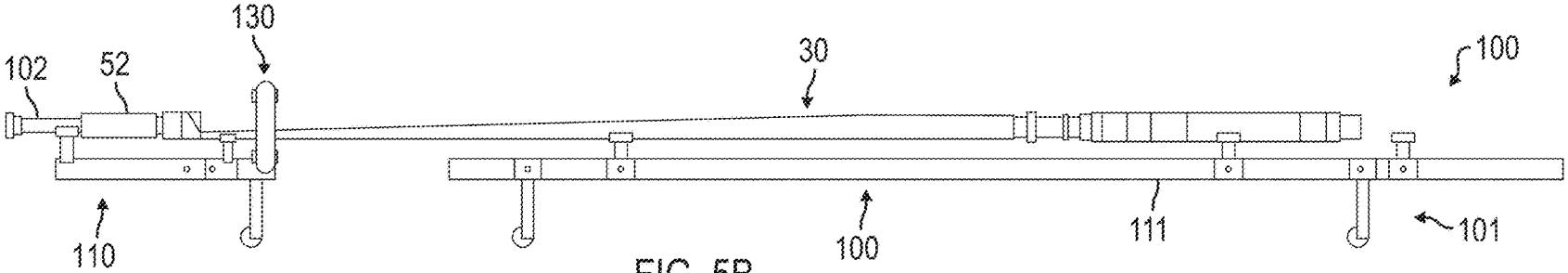
Figure 5C:
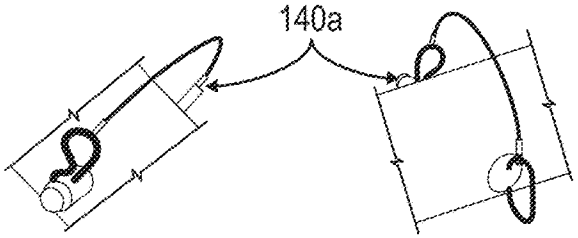

FIGS. 5A-5F illustrate the disclosed cradle 101 during first deployment steps. At the jobsite, the cradle 101 and the assembled equipment are moved to a staging area. As shown in FIGS. 5A-5B, the whipstock assembly 30 is unstrapped from the mounts 120*a-b*, 121*a-c*, and the lower end of equipment (e.g., mechanism 36 and whipstock 32) is lifted with crane lines 104*a-b* to allow the body support member 111 to be separated from the mill support member 110 and base member 130. For example, connections 140*a* having cotter pins such as shown in FIG. 5C can be removed from the securing clevis pins, which connects the ends of the support members 110, 111 together.

Figure 5D:
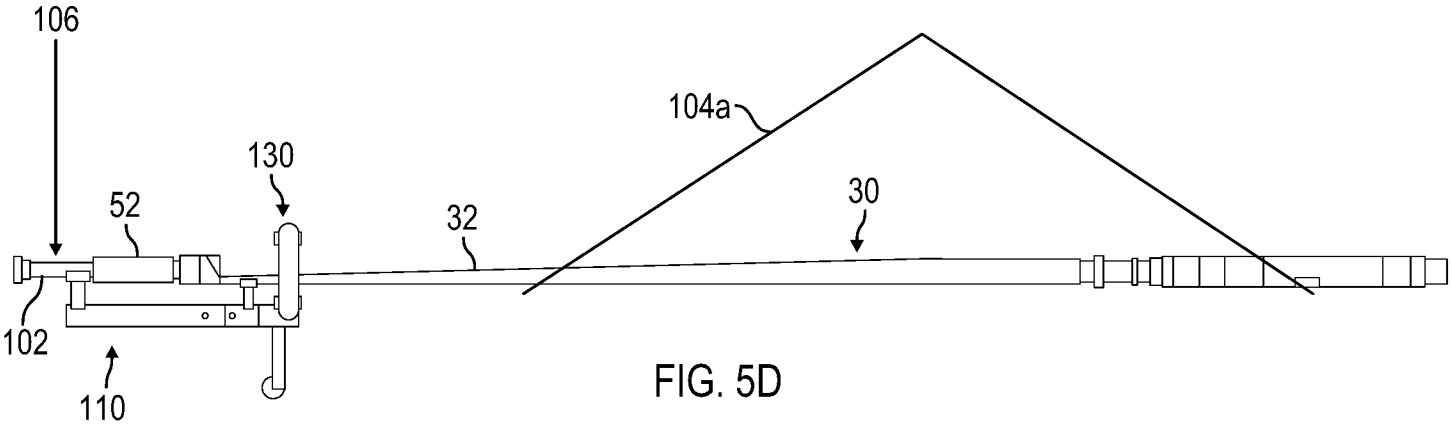

As shown in FIG. 5D, the whipstock assembly 30 (including the lead mill 52, whipstock 32, anchoring mechanism 36) and the mill support member 110 are then lifted to the rig floor. To do this, the lifting sub 102 on the lead mill 52 is engaged with the rig's elevators 106. The top drive on the rig is raised while crane lines 104*c* are simultaneously lowered until the whipstock assembly 30 is positioned vertically over the rig's rotary table (not shown). The crane lines 104*c* can then be removed from the whipstock assembly 30. The steel shipping pins used on the equipment, such as on the anchor 37*b* and packer 37*a*, are replaced with the appropriate shear pins.

Figure 5F:
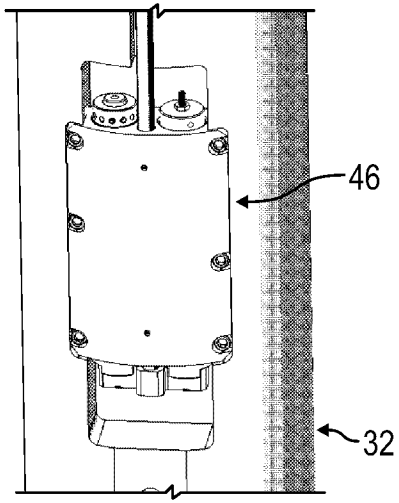
Figure 5E:
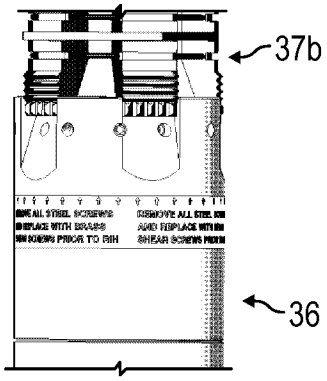

The whipstock assembly 30 is then lowered partially through the rotary table at the rig. Crew members can inspect the packer 37*a* and the anchor 37*b* during this process. As shown in FIG. 5E, crew members can remove the shipping pins from the anchor 37*b* and can install the correct number of shear pins. If already done, crew members can verify that the shipping pins have been removed and that the correct number of shear pins are installed.

As the whipstock assembly 30 is lowered, crew members can also inspect the releasable operational connection 25 installed on the whipstock assembly 30. As shown in FIG. 5F, operators can prepare the latch actuator 46 on the whipstock 32 and other components for operation. The steel shipping pins can be removed and replaced with the correct number of shear pins. The shipping nut is removed as well.

Figure 6C:
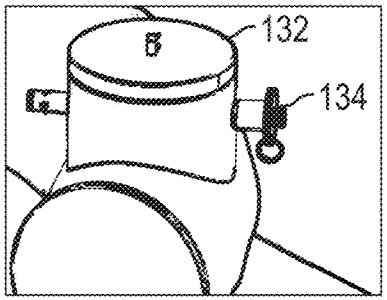
FIGS. 6A-6C illustrate the disclosed apparatus during second deployment steps.
Figure 6B:
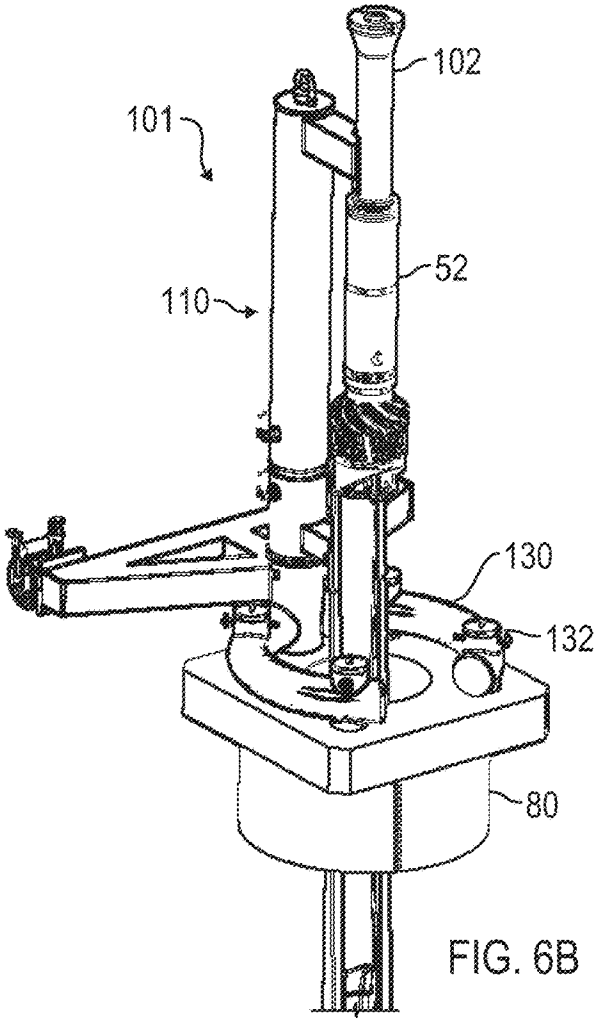
Figure 6A:
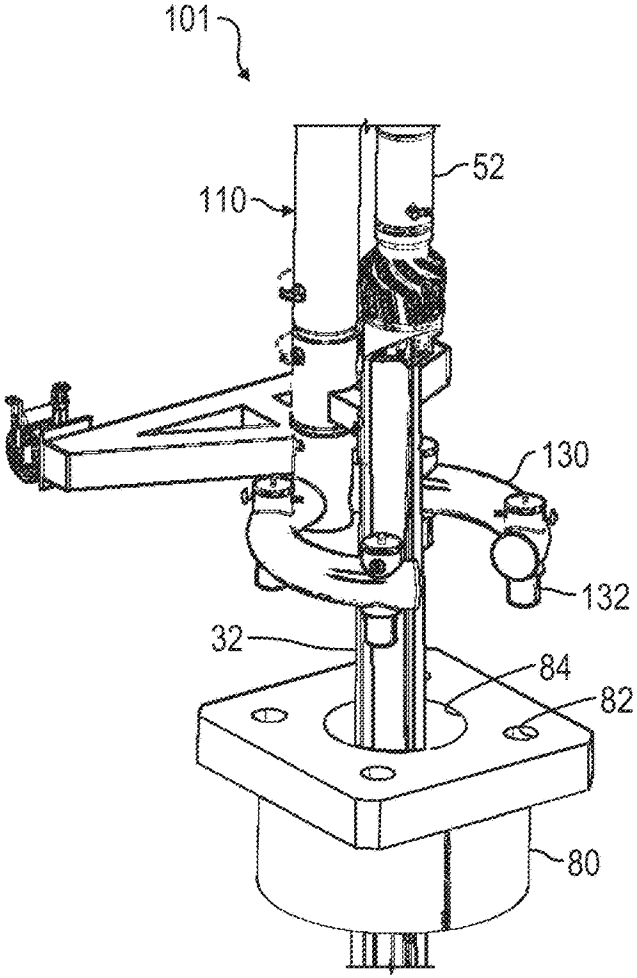

FIGS. 6A-6C illustrate portions (e.g., 110, 130) the disclosed cradle 101 during second deployment steps. As shown in FIGS. 6A-6B, the whipstock assembly and whipstock 32 are lowered through the opening or central passage 84 in a master drive bushing 80 of the rotary table to bring the base member 130 of the cradle 101 adjacent to the master drive bushing 80. Drive pins 132 of the base member 130 are aligned with slots 82 in the master drive bushing 80. These drive pins 132 can be removable from the base member 130 if the particular rig is not equipped with the master drive bushing 80. For example, FIG. 6C shows details of a clevis release pin 134 that allows for removal of the drive pins 132.

Figure 7A:
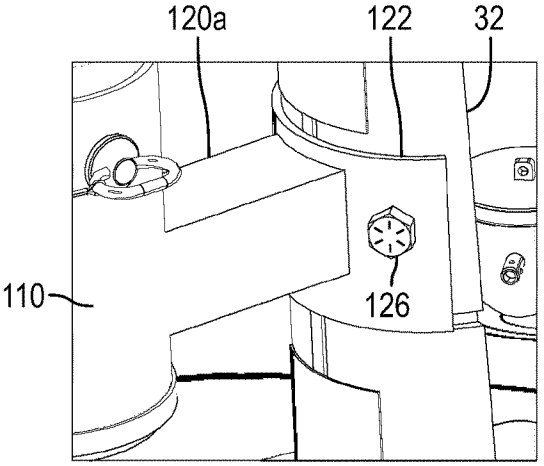
FIGS. 7A-7C illustrate details of a mount on the disclosed apparatus.
Figure 7B:
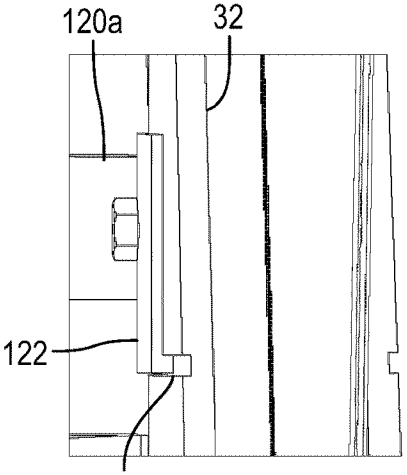
Figure 7C:
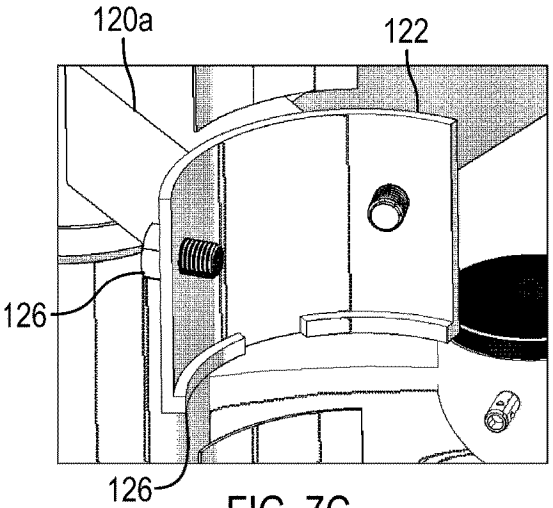

At this point, the whipstock assembly 30 (including the anchoring mechanism 36, the whipstock 32, and the lead mill 52) are secured and fully supported on the rig floor. FIGS. 7A-7C illustrate details of the whip mount 120*a* on the disclosed cradle (101). In general, the whip mount 120*a* can be supported on the mill support member 110 and/or the base member (130). The whip mount 120*a* has a flange 122 that affixes with bolts or fasteners 126 to the whipstock 32. Lugs or shoulders 124 on the flange 122 can engage in a profile on the back of the whipstock 32 to ensure that the bolts or fasteners 126 are not loaded in shear.

Figure 8A:
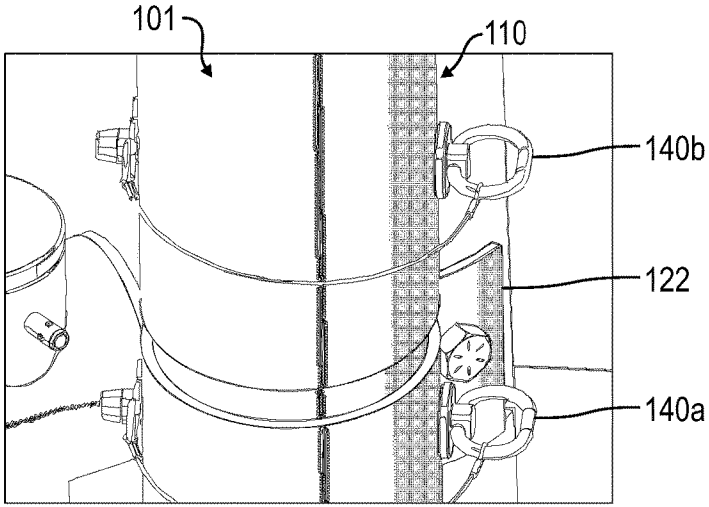
FIGS. 8A-8E illustrate the disclosed apparatus during third deployment steps.
Figure 8B:
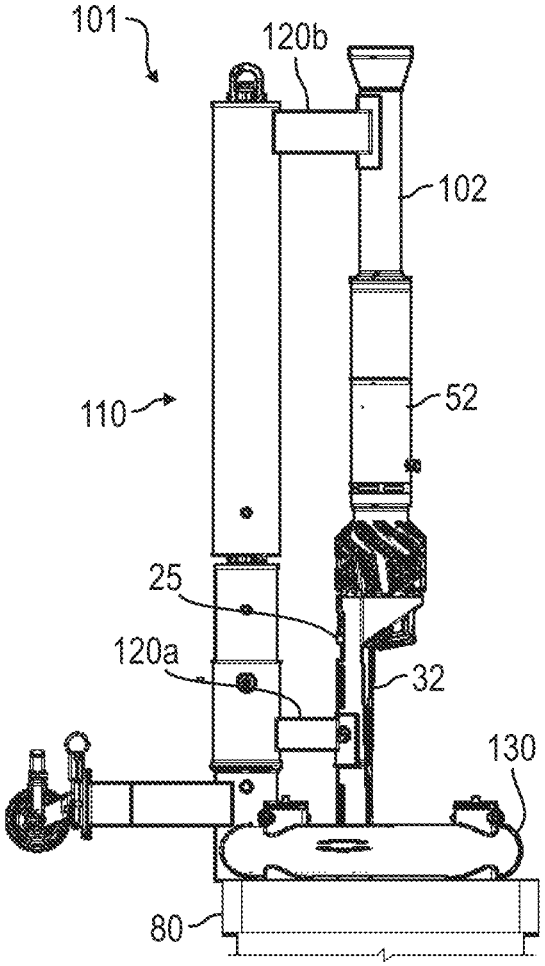
Figure 8C:
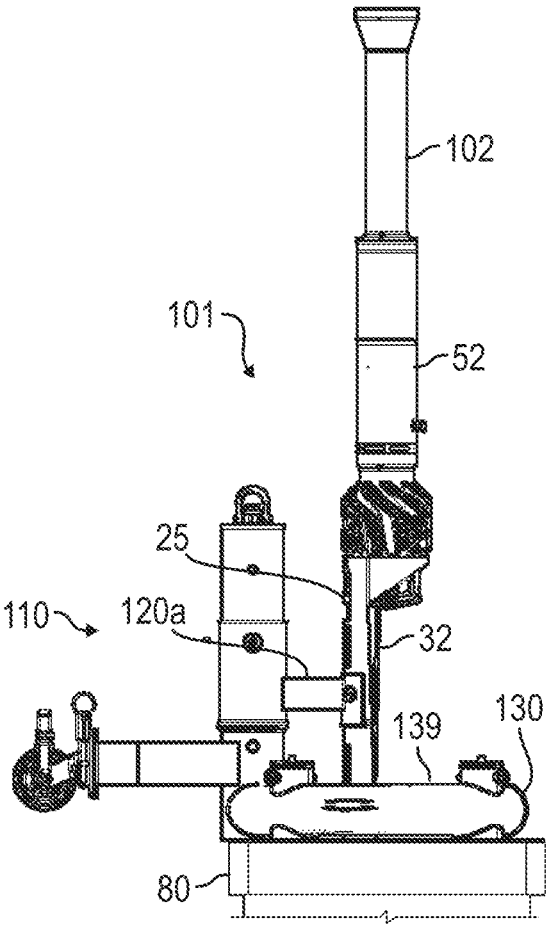

FIGS. 8A-8E illustrate the disclosed cradle 101 during third deployment steps. Crew members remove the cotter pin that secures clevis pin 140*b* on the mill support member 110. The clevis pin 140*b* securing a portion of the mill support member 110 is removed, and the upper portion of the mill support member 110 is lifted, as shown in FIG. 8B.

If not already installed, a man saver 139 is installed on the base member 130 over the master drive bushing 80 in the rotary table. Crew members then inspect the lead mill 52. If not already done, the steel shipping pins are replaced with the correct number of shear pins.

Figure 8D:
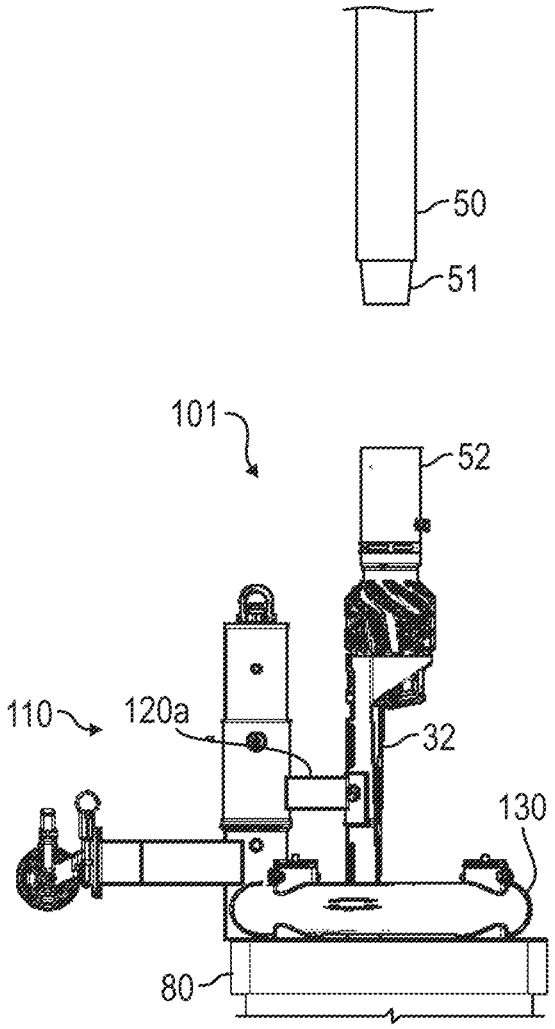
Figure 8E:
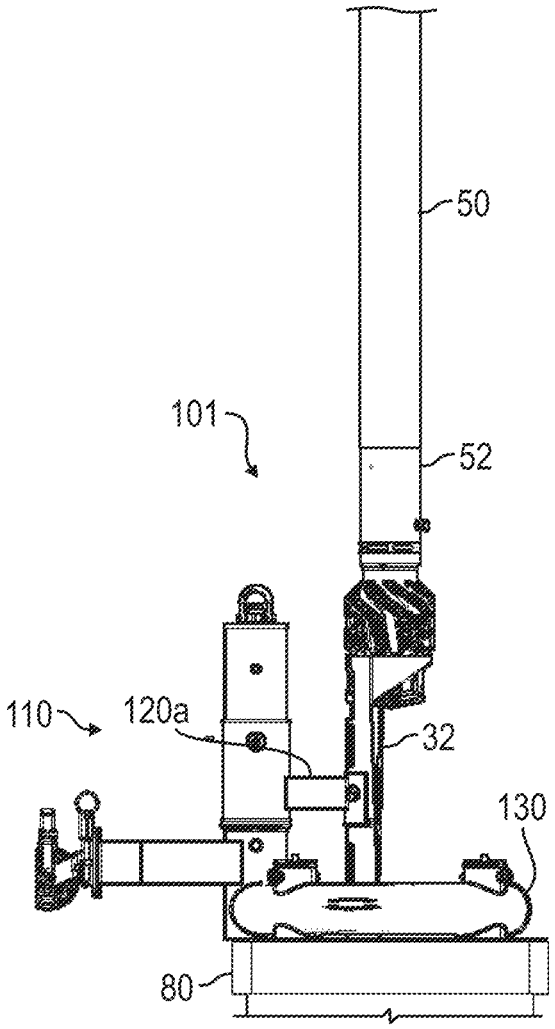

The connection of the lifting sub 102 to the lead mill 52 is now broken using the Iron Roughneck of the rig. As shown in FIG. 8D-8E, the other portion of the milling assembly 50 is then lifted utilizing its attached lifting sub (not shown). The thread protector (not shown) is removed from its coupling 51, and pipe dope is applied to the threads. The coupling 51 of the milling assembly 50 is stabbed into the lead mill 52, and the connection is torqued using the Iron Roughneck.

Figure 9A:
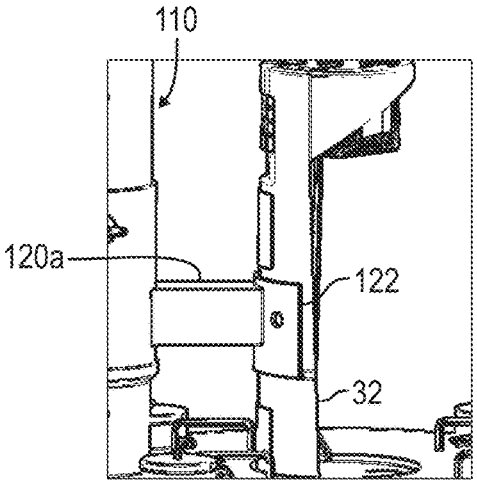
FIGS. 9A-9E illustrate the disclosed apparatus during fourth deployment steps.
Figure 9B:
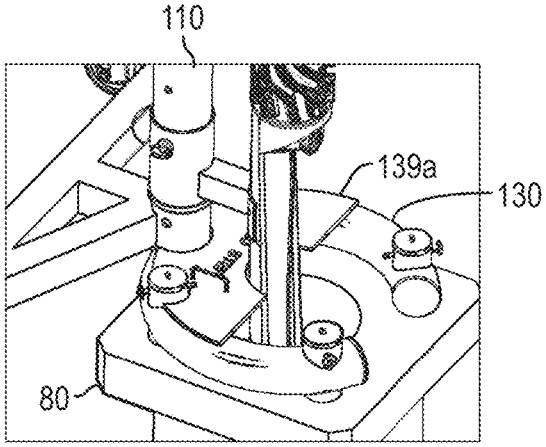

FIGS. 9A-9E illustrate the disclosed cradle 101 during fourth deployment steps. The fasteners on the flange 122 are removed on the whip mount 120*a* so the whipstock 32 is suspended by the lead mill 52 connected to the milling assembly (50). As shown in FIG. 9A, the bolts on the whip mount 120*a* are removed, and the outboard man saver is opened to leave only the inboard man saver 139*a* as shown in FIG. 9B.

Figure 9C:
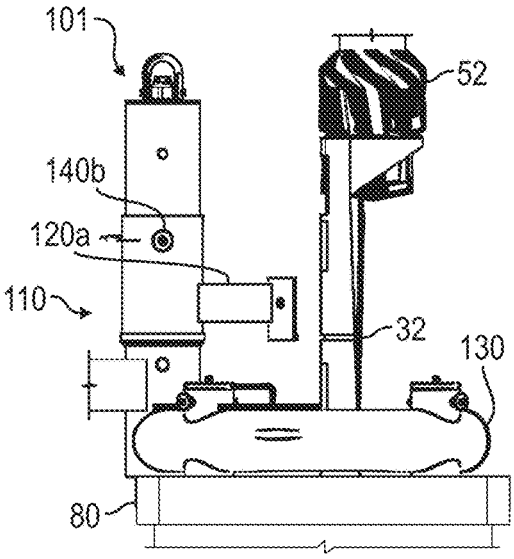
Figure 9D:
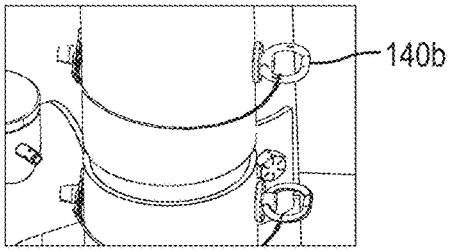
Figure 9E:
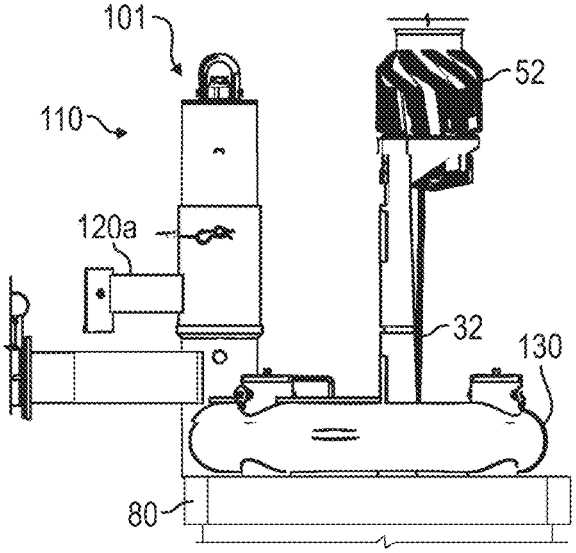

As shown in FIG. 9C, the entire bottom hole assembly (20) is now picked up to neutral weight, and the whipstock 32 is positioned off centerline utilizing the top drive to disengage it from the whip mount 120*a*, which can then be rotated out of the way. As shown in FIGS. 9D-9E, for example, the cotter pin and clevis pin can be removed to rotate the whip mount 120*a*, and the pins can be re-installed.

The inboard man saver 139*a* is removed, and the bottom hole assembly (20) is repositioned to centerline to prepare running in hole.

Figure 10A:
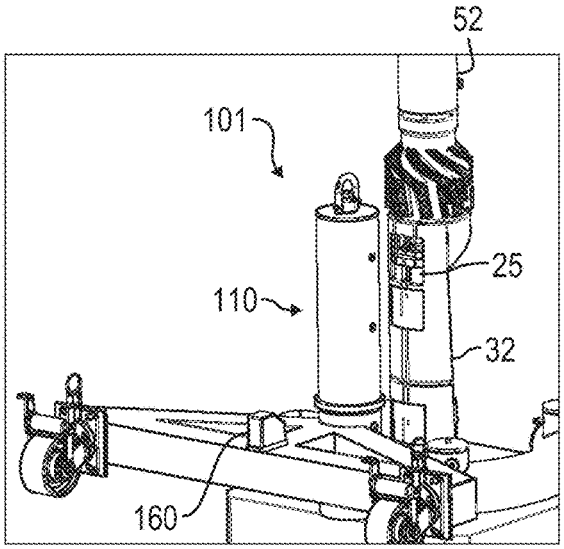
FIGS. 10A-10B illustrate the disclosed apparatus during fifth deployment steps.
Figure 10B:
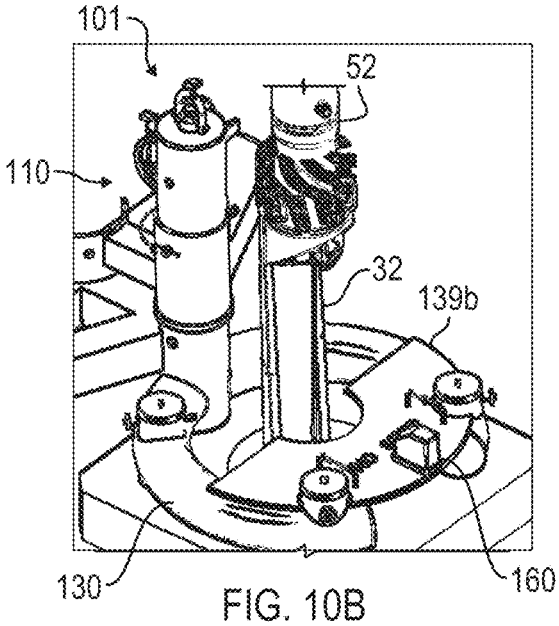

FIGS. 10A-10B illustrate the disclosed cradle 101 during fifth deployment steps. At this point, a laser 160 is positioned to mark the orientation of the whipstock 32 to other elements of the bottom hole assembly (20), such as measurement-while-drilling equipment. In one option shown in FIG. 10A, the laser 160 is placed on a portion of the mill support member 110, such as on the support leg 112 extending away from the assembly, to project a vertical beam indicating the backside of the whip's inclined face. The whip mount 120*a* would need to be removed so as to not obstruct the beam. In another option shown in FIG. 10B, the laser 160 is positioned on the outboard man saver 139*b* to project the vertical beam indicating the frontside of the whip's inclined face. The laser 160 can be a ruggedized, commercial laser, which is preferably capable of projecting a beam of about 100 ft or so and that is water and shock proof.

Figure 11A:
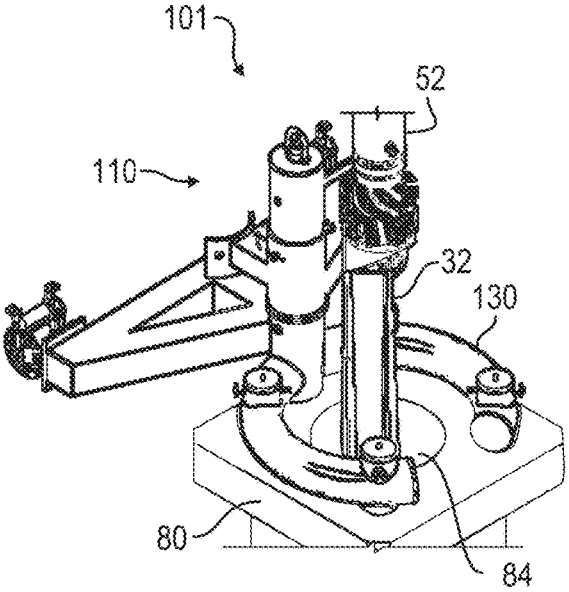
FIGS. 11A-11B illustrate the disclosed apparatus during final deployment steps.
Figure 11B:
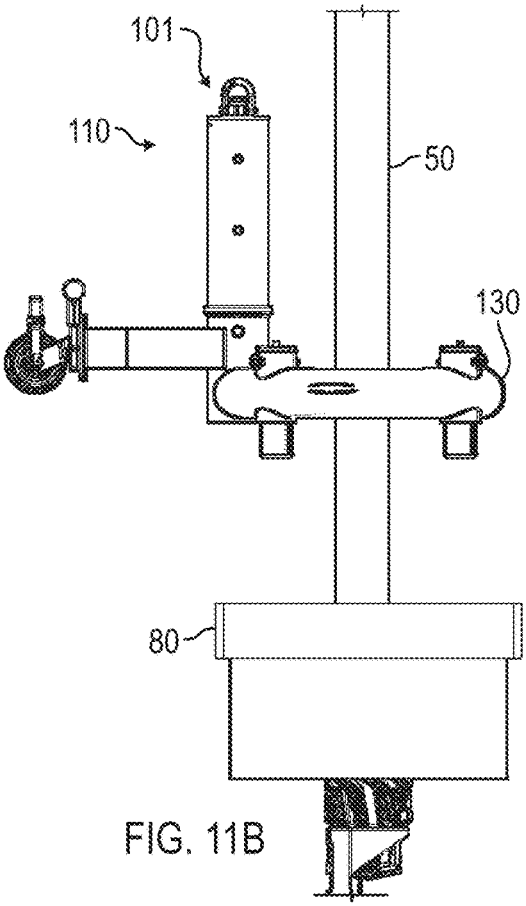

After recording orientation data for measurement-while-drilling purposes, the mill support member 110 can be removed and set aside, and the bottom hole assembly (20) having milling assembly 50 and the whipstock assembly (30) can be deployed through the rotary table at the rig, as shown in FIG. 11A-11B. Eventually, at any desired point, the base member 130 can also be removed and set aside.

Figure 12:
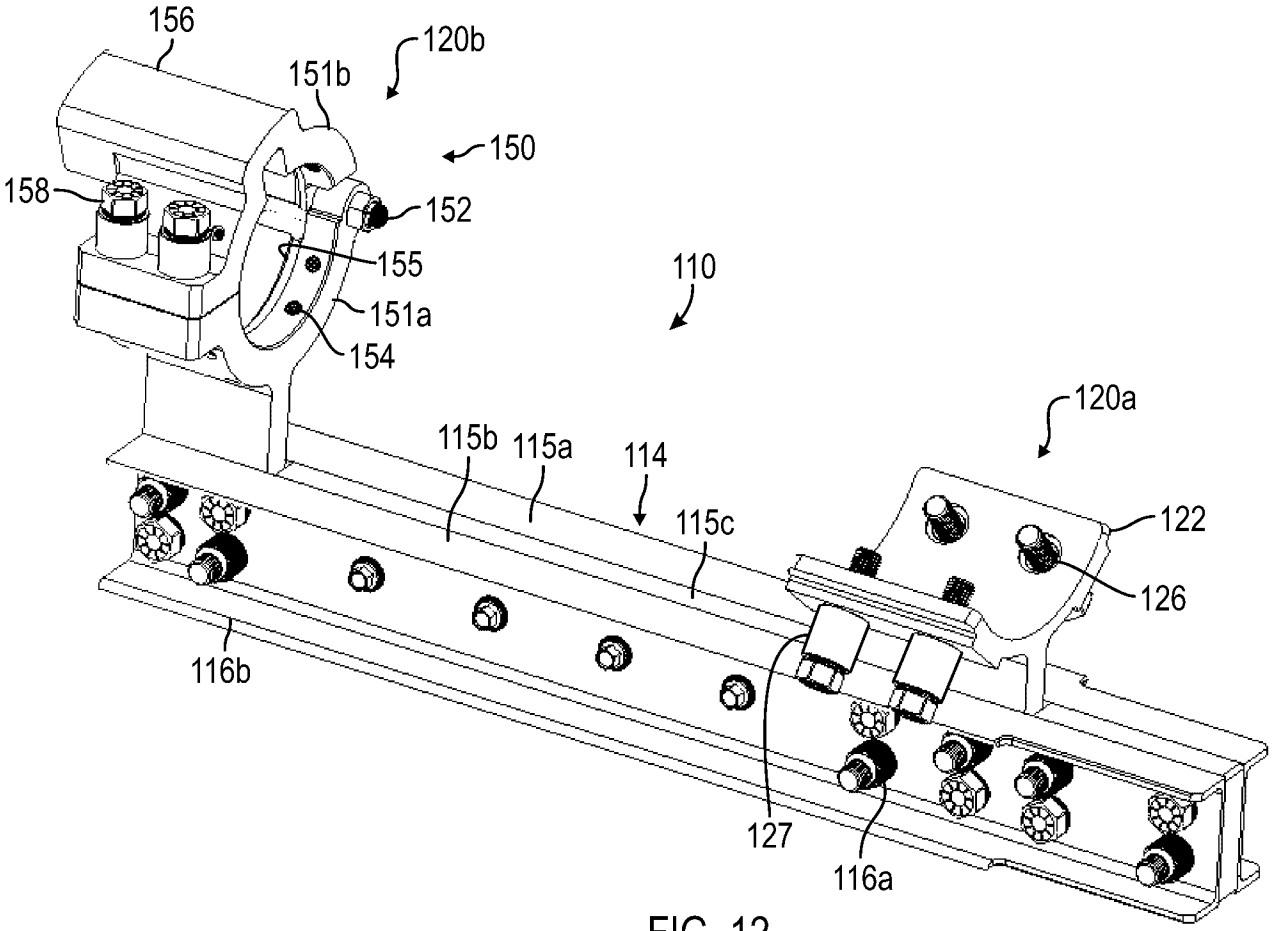
FIG. 12 illustrates a perspective view of a first component or mill support member of another apparatus according to the present disclosure to assembly, transport, and deploy components of a bottom hole assembly.

FIGS. 12 through 21B illustrate another apparatus 100 according to the present disclosure used to assemble, transport, and deploy components of a bottom hole assembly. FIG. 12 illustrates a perspective view of a first component, namely a mill support member 110, and FIGS. 13A-13B illustrate a perspective view and a side view of a second component, namely a base member 130, of a cradle for the disclosed apparatus 100.

Details of the mill support member 110 and base member 130 for the disclosed cradle can be similar to those discussed above so that similar reference numerals are used. The mill support member 110 supports the attachment of the lead mill 52 to the whipstock assembly 30 to protect the shear bolt or other releasable operational connection 25 and the hydraulic line from damage during transportation and handling. The base member 130 supports the support member 110 and the whipstock assembly 30 at the rotary table.

As shown in FIG. 12, the mill support member 110 includes a support beam 114 having mounts 120*a-b*. As shown, the support beam 114 can include side beams 115*a-b* affixed with fasteners together. The side beams 115*a-b* can sandwich intermediate plates 115*c* and ends of the mounts 120*a-b* therebetween. This provides a modular arrangement to the components of the mill support member 110. Different lengths of side beams 115*a-b* and plates 115*c* can be used with existing mounts 120*a-b* to configure the support member 110 for different implementations. Additionally, different sized or configured mounts can be used with side beams 115*a-b* and plates 115*c* to meet the needs of given implementations. Overall, the mill support member 110 can be designed to meet required sizing needs and strength requirements.

As discussed below, the mill support member 110 removably supports the releasable operational connection (25) between the whipstock (32) and the lead mill (52). To do this, the support member 110 has first and second mounts 120*a-b*. In general, the first or whip mount 120*a* is configured to releasably engage a portion of the whipstock (32), and the second or mill mount 120*b* is configured to releasably engage a portion of the lead mill (52).

In particular, the whip mount 120*a* removably affixes to and supports the whipstock (32). Meanwhile, the mill mount 120*b* removably affixes to and supports the lead mill (52). For example, one end of the whip mount 120*a* affixes to the support beam 114 with fasteners 116*a*. The other end of the whip mount 120*a* includes a flange 122 having fasteners 126 and washers 127, which are used to removably affix to and support the whipstock (32).

Additionally, one end of the mill mount 120*b* affixes to the support beam 114 with fasteners 116*b*. The other end of the mill mount 120*b* includes a clamp assembly 150, which is used to removably affix to and support the lead mill (52). The clamp assembly 150 includes two or more clamp members 151*a-b* connected by a hinged connection 152. The clamp members 151*a-b* can open and close about the hinged connection 152. When closed, the ends of the clamp members 151*a-b* can affix closed with clamp fasteners 158. The outer clamp member 151*b* can have a shroud 156, which is discussed below.

The clamp assembly 150 also includes an inner shoulder 155 and set screws 154 to engage the lead mill 52. The set screws 154 can have carbide tips. The set screws 154 extend in threaded openings about the circumference of the clamp members 151*a-b* and can be tightened against a portion of the lead mill (52) when clamped in the clamp assembly 150. The set screws 154 grip the lead mill 52 and can prevent damage to the shear bolt or other releasable operational connection (25) when making up the milling assembly (50) to the lead mill 52.

Figure 13A:
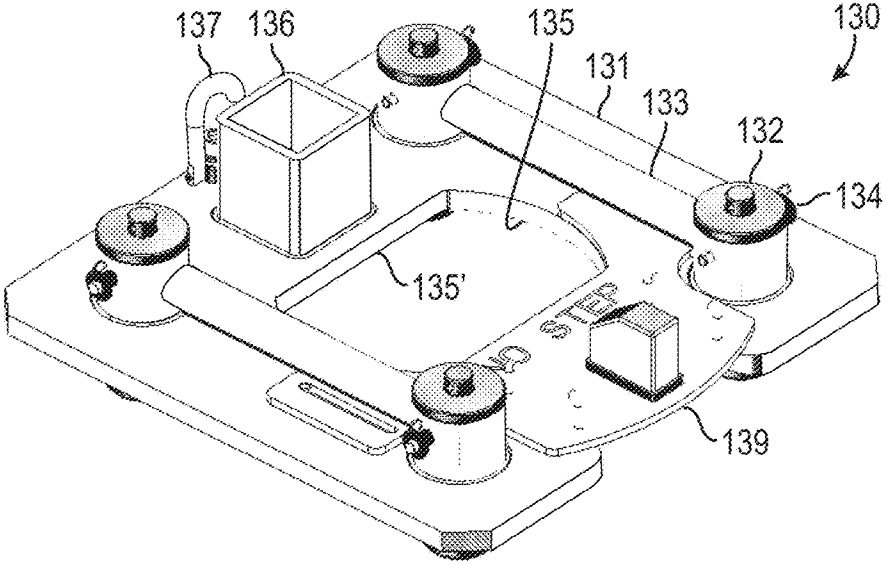
FIGS. 13A-13B illustrate a perspective view and a side view of a second component or base member of the disclosed apparatus.
Figure 13B:
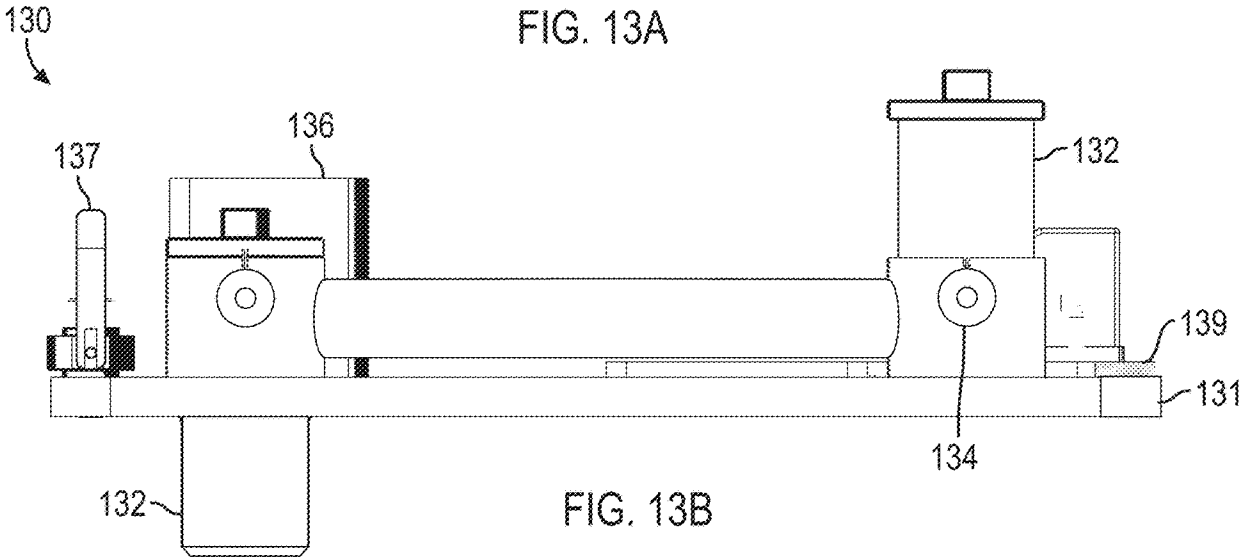

Turning to the perspective and side views of FIGS. 13A-13B, the base member 130 is configured to position at the rotary table of the rig with an end of the whipstock (32) extending through the base member 130. When the whipstock assembly (30) is being prepared for deployment, the base member 130 is configured to support the support member 110.

The base member 130 includes a base body 131, which can be a plate member defining a central opening 135 with a side cutout. As discussed below, the base member 130 rests on a portion of the rig, such as a master drive bushing (80) in the rotary table. When positioned, the base member 130 has an end of the whip (34) extending through the central opening 135.

A receptacle 136 extends from a top of the base body 131 and is configured to receive a lower end of the support beam (114) of the mill support member (110). A man saver 139 can be removably positioned over portions of the central opening 135. A lifting eyelet 137 can be provided on the base body 131.

A plurality of drive pins 132 are disposed on the base body 131 and can be moved between retracted and extended conditions to extend below the base body 131. For example, release pins 134 can insert into pin receptacles on the base body 131 to lock the drive pins 132 in the extended condition. Accordingly, the drive pins 132 can be pinned in two positions (engaged or retracted) with the release pins 134 without need to remove the drive pins 132 from the base member 130. This feature, combined with tethers for the release pins, can reduce the possibility of dropped objects downhole and other issues at the rig. As shown, lateral bars 133 can connect together the adjacent pin receptacles for the drive pins 132 and can provide additional support and/or lifting points.

Having an understanding of the mill support member 110 and the base member 130 of the disclosed cradle, discussion turns to how these components of the apparatus 100 are used to assemble, transport, and deploy components of a bottom hole assembly (20) having a whipstock assembly (30), a lead mill (52), and a milling assembly (50).

Initially, the whipstock assembly (30) is assembled in a workshop. An internal sleeve and its nozzle are installed in the lead mill (52), and the lead mill 52 is made up to the lifting sub (102) used for lifting and handling. The hydraulic fitting (72) and are attached to the lead mill (52), and the hydraulic line (not shown) is routed through the blades of the lead mill (52).

Figure 14A:
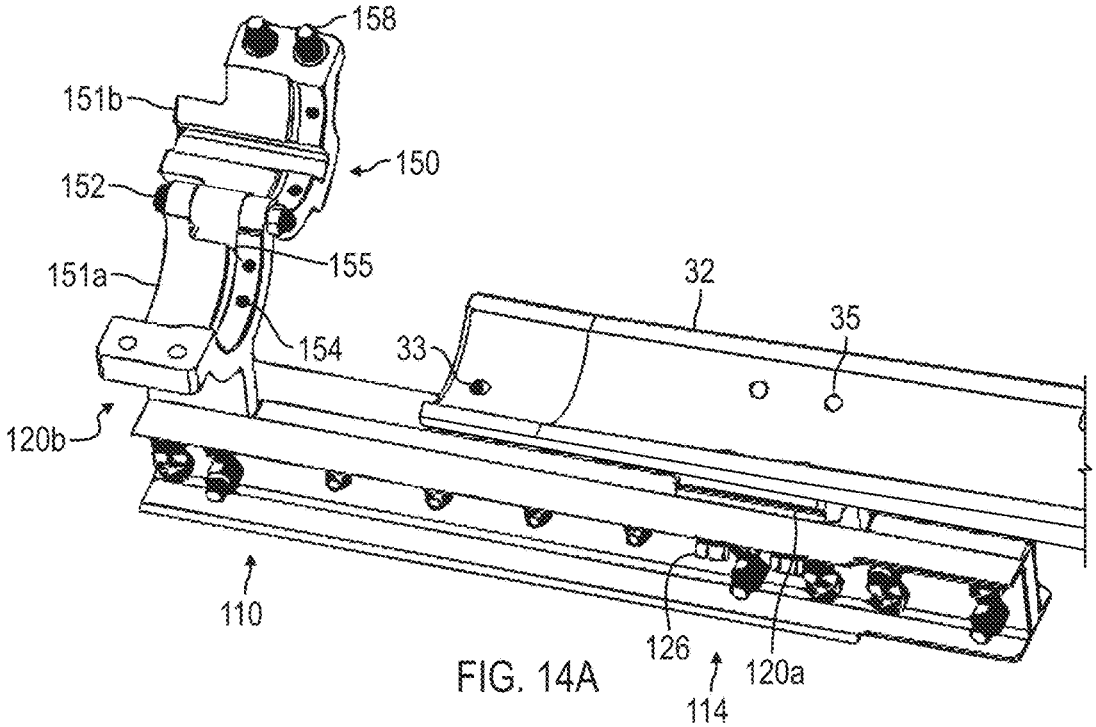
FIGS. 14A-14C illustrate details for affixing the mill support of the disclosed apparatus to a whipstock assembly.
Figure 14B:
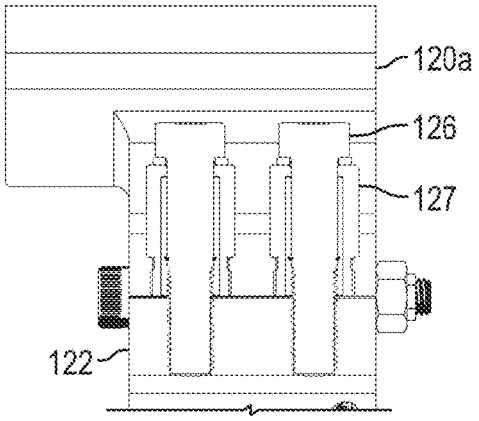
Figure 14C:
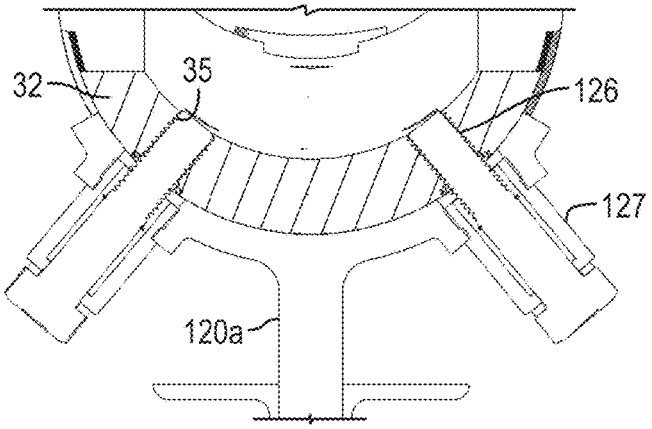

As then shown in FIGS. 14A, the beam fasteners 116*a* are loosened for the whip mount 120*a* on the mill support member 110 to allow for adjustment during alignment. The whip mount 120*a* on the mill support member 110 is then attached to the concave side of the whipstock 32 by threading the fasteners 126 into the threaded openings 35 in the whipstock 32. The fasteners 126 are then torqued to required value. In particular as shown in FIGS. 14B-14C, the fasteners 126 extend through the mount's flange 122 and thread into threaded openings 35 in the whipstock 32. Preferably, the washers 127 and threads for the fasteners 126 have features to provide vibration resistance.

Figure 15A:
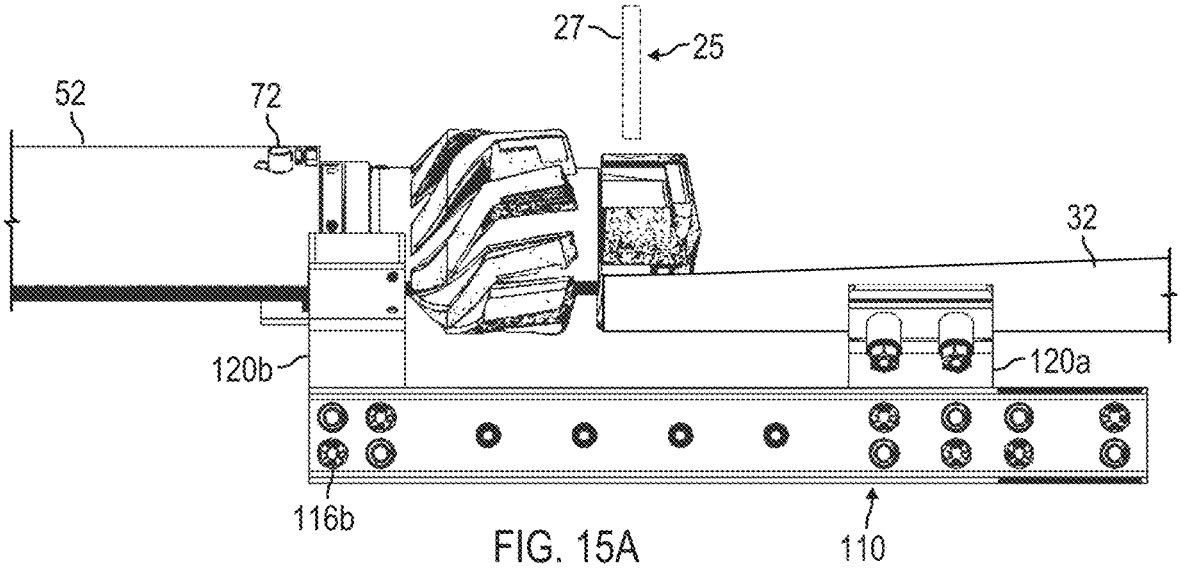
FIGS. 15A-15D illustrate details for affixing the mill support of the disclosed apparatus to a lead mill.
Figure 15B:
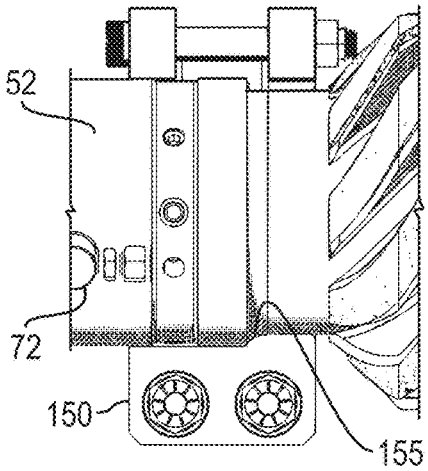

As shown in FIG. 15A, the fasteners 116*b* for the mill mount 120*b* supporting the mill mount 120*b* having the clamp assembly 150 are loosened to allow for adjustment during alignment, and the clamp assembly 150 of the mill support member 110 is opened to receive the lead mill 52. The lead mill 52 is then placed at the distal end of the whipstock 32 and the clamp assembly 150 of the mill support member 110. A lifting sling (not shown) can the lead mill 52 during installation.

The releasable operational connection 25 is then assembled to connect the lead mill 52 to the whipstock 32. For example, a shear bolt (27) if used for the releasable operational connection 25 can be installed into the lead mill 52 and an opening or aperture (33: FIG. 14A) on the whipstock 32. The shear bolt 27 of the releasable operational connection 25 can be torqued as required to connect the lead mill 52 to the whipstock 32, and a retainer for the shear bolt 27 can be installed. If a different releasable operational connection 25 is used, such as a hydraulic release mechanism, those elements can be connected instead.

Hydraulic testing can be performed at this point for the hydraulic components. For example, the hydraulic fitting 72 can be removed on the lead mill 52 so the neck of the lead mill 52 can be filled with hydraulic fluid through the hydraulic port (55*a*). Shipping bolts are installed, and hydraulic integrity pressure tests can be performed. Once testing is completed, the hydraulic fitting 72 is reinstalled, the shipping bolts are removed, and operations shear pins (not shown) for the lead mill 52 are installed.

As shown in FIGS. 15B-15E, the clamp members 151*a-b* of the mill support's clamp assembly 150 are closed on the neck of the lead mill 52, and the clamp fasteners 158 affix the members 151*a-b* together.

The resulting assembly is then set up for proper fitting. The captive set screws 154 are hand tightened. The mill mount 120*b* and the clamp assembly 150 are pulled to ensure its inner shoulder 155 is firmly engaged with an upset around the outside of the lead mill 52. The captive set screws 154 are then tightened to the required torque. All of the beam fasteners 116*a-b* can then be torqued. Preferably, the openings in the support beam 114 for the fasteners 116*a* are slotted to allow for adjustments to compensate for manufacturing tolerances during set up and to allow for proper fitting. The lifting sling is no longer needed to support the lead mill 52, which is now affixed to the mill support member 110 and is releasably connected by the releasable operational connection 25 to the whipstock 32.

Figure 15C:
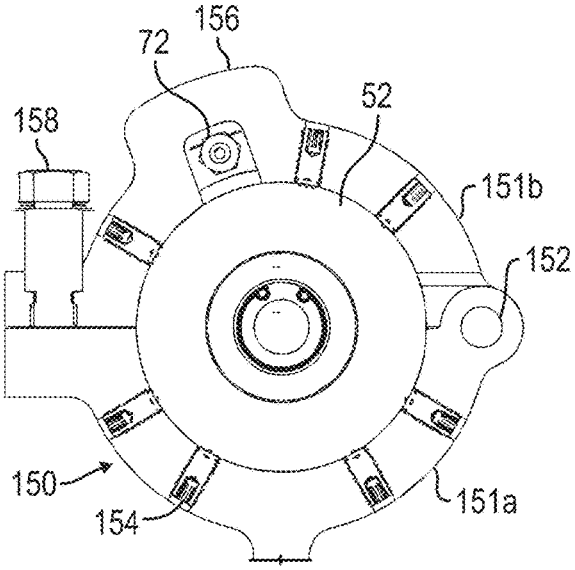
Figure 15D:
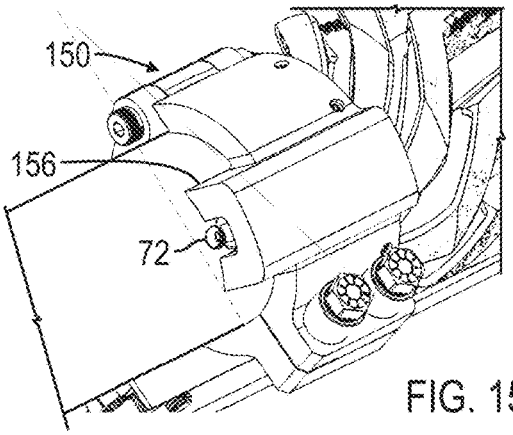

As further shown in FIGS. 15C-15E, the shroud 156 on the clamp assembly 150 can enclose/protect the hydraulic fitting 72 on the neck of the lead mill 52 to prevent damage during handling or when making up connections with an Iron Roughneck.

Figure 17A:
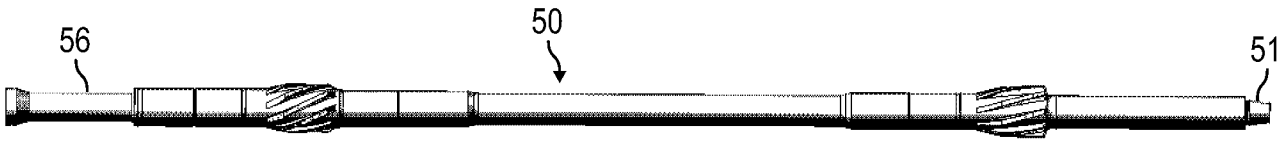
FIG. 17A illustrates a milling assembly for deployment according to the present disclosure.

Separately, operators make up the other components. For example, operators assemble components of a milling assembly 50 minus the lead mill 52. FIG. 17A illustrates a milling assembly 50 according to the present disclosure. An upper lifting sub 56 can be attached to milling assembly 50. For shipping, the equipment can be loaded/secured into a shipping container or the like to be transported to a rig site. At the rig site, the milling assembly 50 is lifted to the rig floor, and its lifting sub is removed so additional components, such as MWD and SSM, can be made up to the milling assembly 50. The milling assembly 50 can then be racked for later retrieval.

Figure 16A:
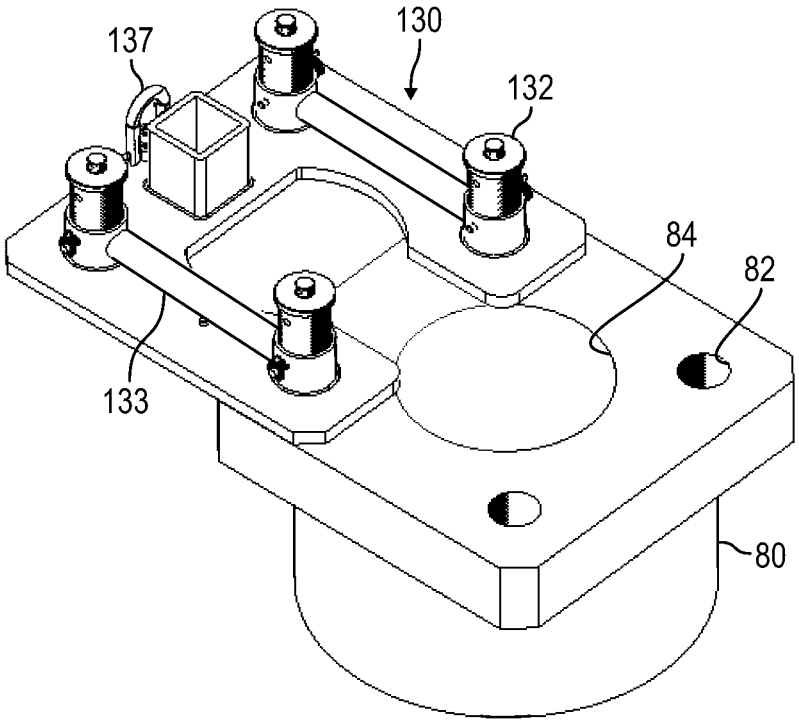
FIGS. 16A-16B illustrate steps for installing the base assembly at a rig.
Figure 16B:
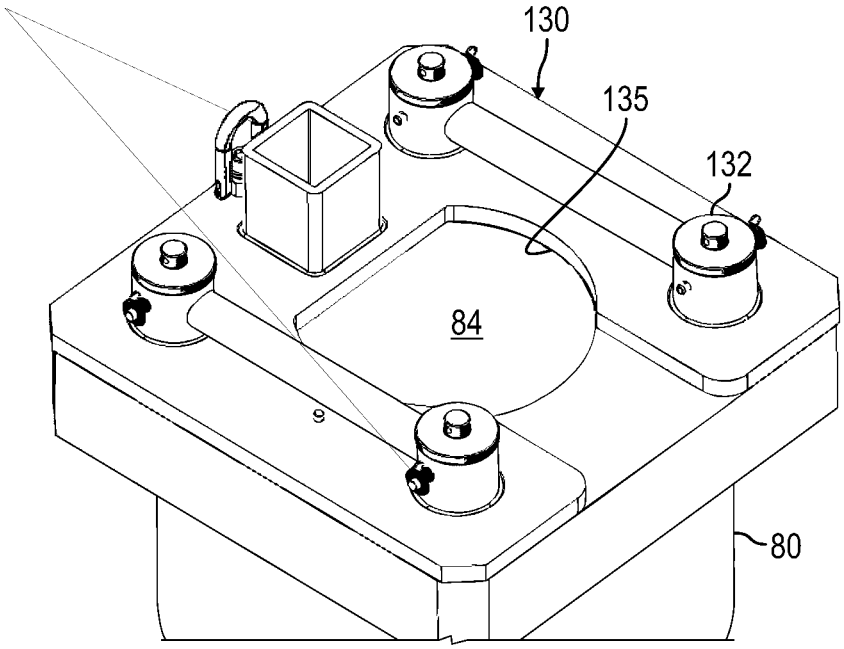

For its part, the base member 130 is also lifted to the rig floor and installed at the rig. For example, FIGS. 16A-16B illustrate steps for installing the base member 130 at the rig. Various lifting options are available, including using a lifting line connected to the lifting eyelet 137 or using one or more lifting lines wrapped or looped around the lateral bars 133.

Once lifted to the rotary table, the base member 130 is then centered over the opening in the rotary table. If the rig is equipped with a master drive bushing 80 in the rotary table as shown, the drive pins 132 can be retracted while placing the base member 130 on the bushing 80. The release pins 134 can then be pulled to lower the drive pins 132 from the retracted position to the extended position so the drive pins 132 can engage in the slots 82 of the bushing 80. The release pins 134 can then be reinstalled to secure the drive pins 132 in the extended position. The central opening 135 in the base member 130 is open to the central passage 84 of the bushing 80.

Figure 17B:
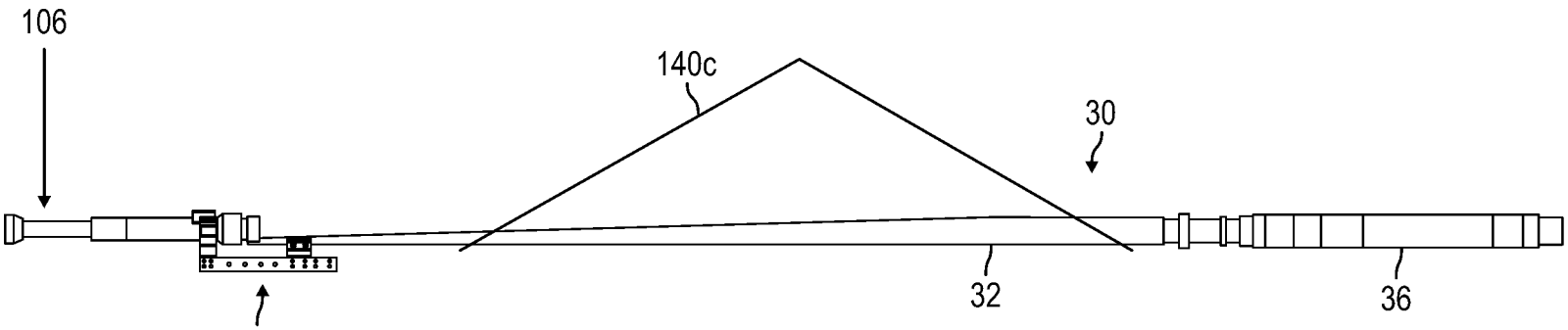
FIGS. 17B-17C illustrate steps for lifting the whipstock assembly for installation at the rig.
Figure 17C:
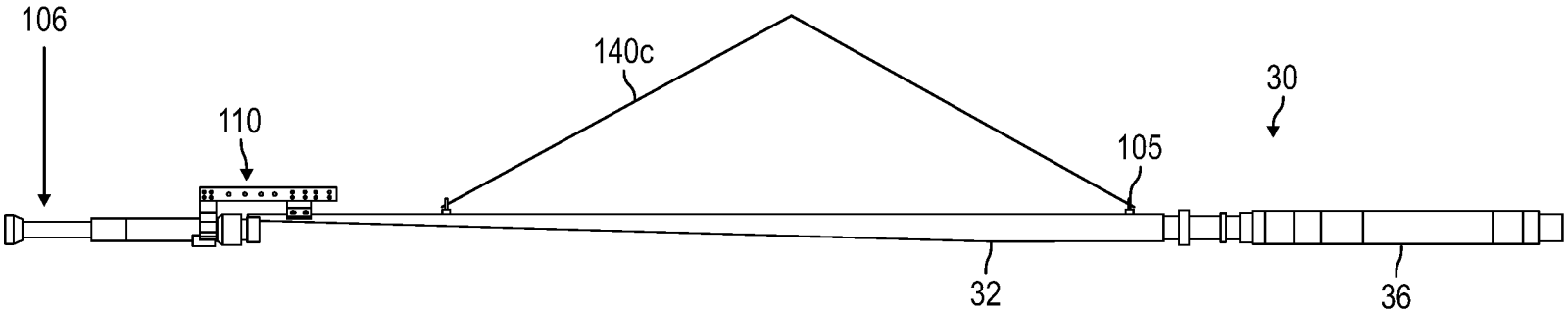
Figure 18B:
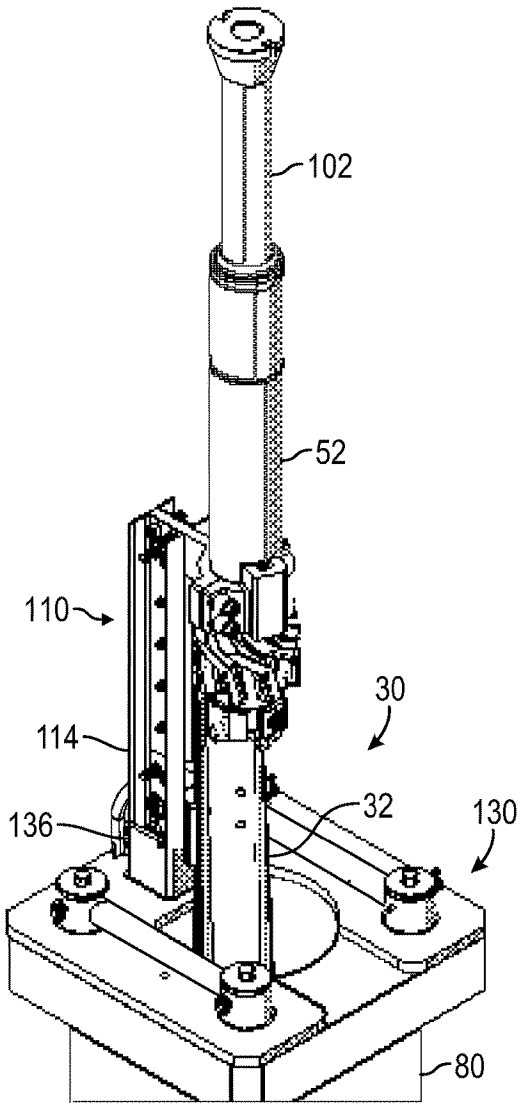
FIGS. 18A-18D illustrate steps for lowering and supporting the whipstock assembly for deployment at the rig.
Figure 18A:
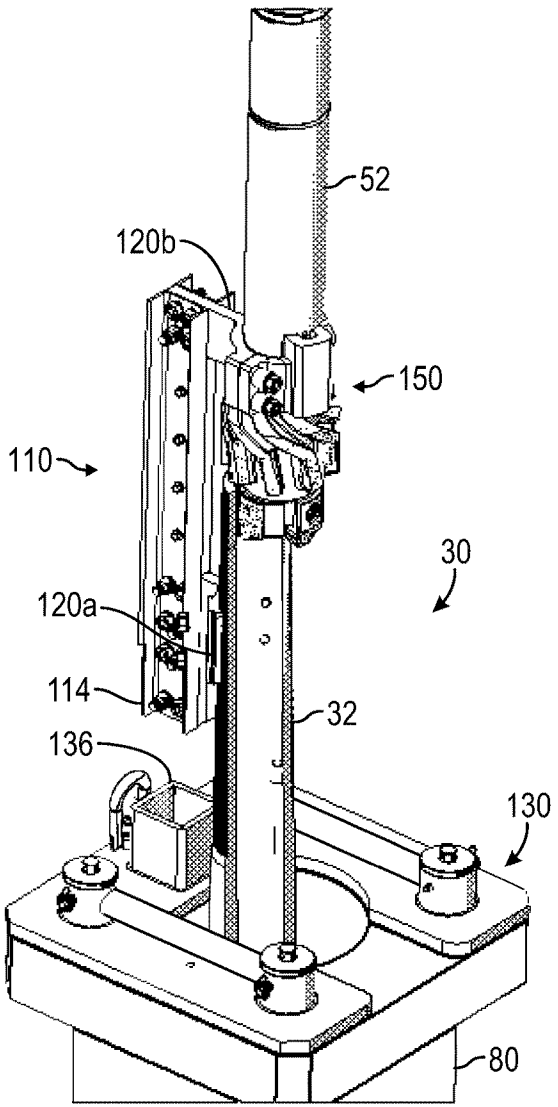
Figure 18C:
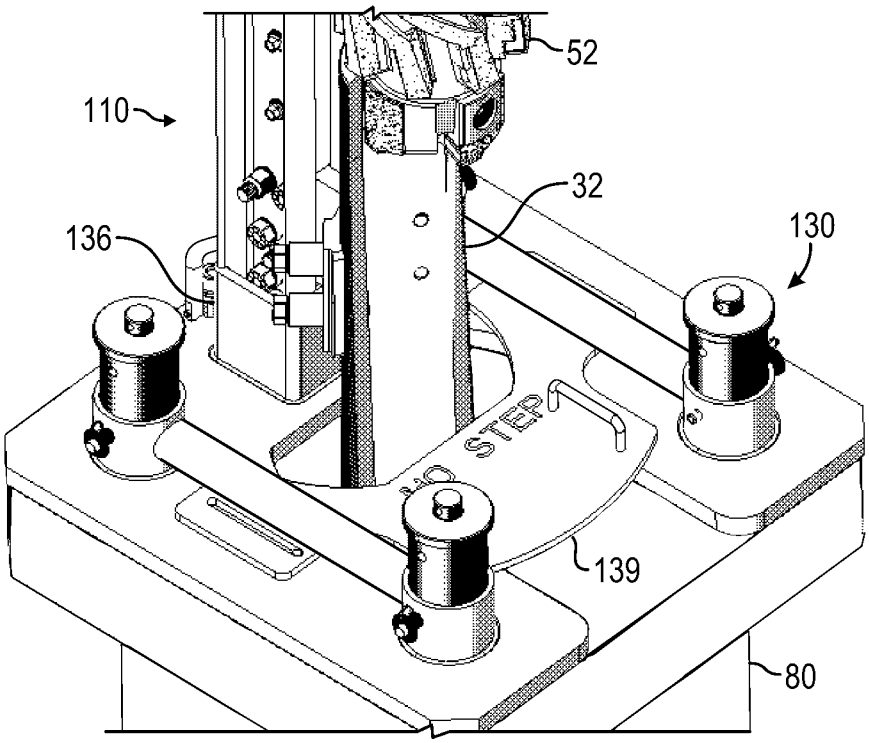
Figure 18D:
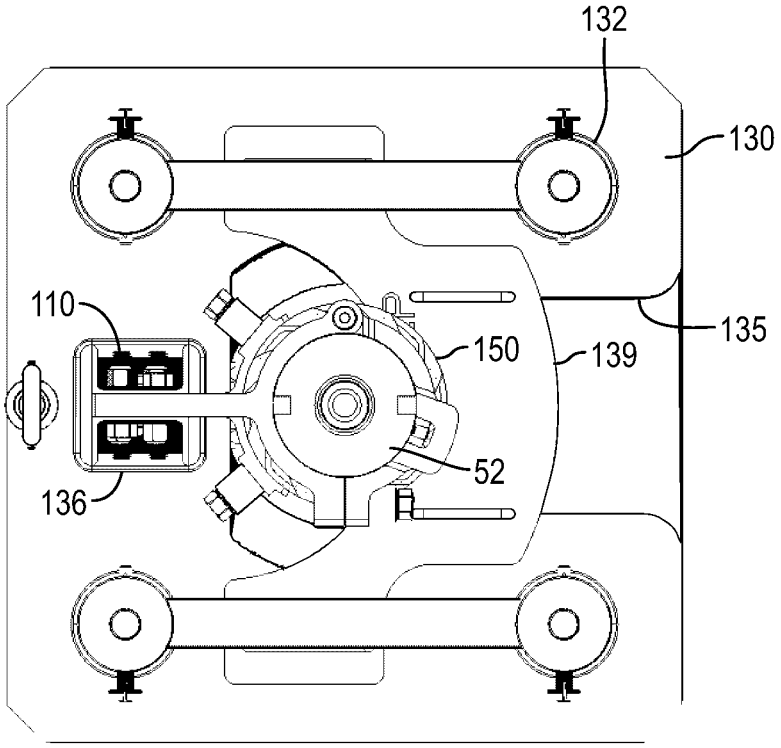

Now that the base member 130 is in place, operators lift the whipstock assembly 30 to the rig floor. FIGS. 17B-17C illustrate steps for lifting the whipstock assembly 30 for installation at the rig. For instance, the lifting sub 102 on the lead mill 52 can be engaged with elevators 106. The whipstock assembly 30 can be handled with crane lines 104*c* wrapped around the whip as shown in FIG. 17A. Alternatively, the crane lines 104*c* can connect to lifting eyes 105 as shown in FIG. 17B.

During the lifting process, the top drive of the rig is raised while simultaneously lowering the crane lines 104*c* until the whipstock assembly 30 is vertical over the rotary table. The crane lines 104*c* and any lifting eyes (if provided) are removed. Operators then begin lowering the whipstock assembly 30 through the base member 130 and the rotary table.

FIGS. 18A-18D illustrate steps for lowering and supporting the whipstock assembly 30 for deployment at the rig. As the whipstock assembly 30 is lowered through the base member 130 and the bushing 80, the support beam 114 of the mill support member 110 is stabbed into the receptacle 136 of the base member 130. As shown, the receptacle 136 on the base member 130 can preferably be squared or cornered to support the support beam 114 and prevent rotation without any need for pins or additional features. The man saver 139 is then installed on the base member 130 before performing any additional work. The man saver 139 can be adjustable to minimize possibility of objects dropped downhole while providing mounting location for a laser (not shown) while tripping into the well.

Figure 19C:
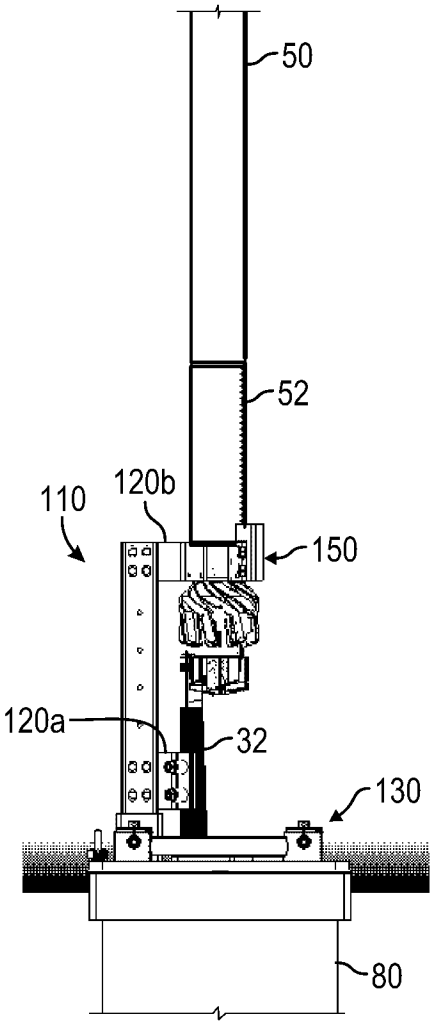
FIGS. 19A-19C illustrate steps for connecting the milling assembly to the whipstock assembly for deployment at the rig.
Figure 19B:
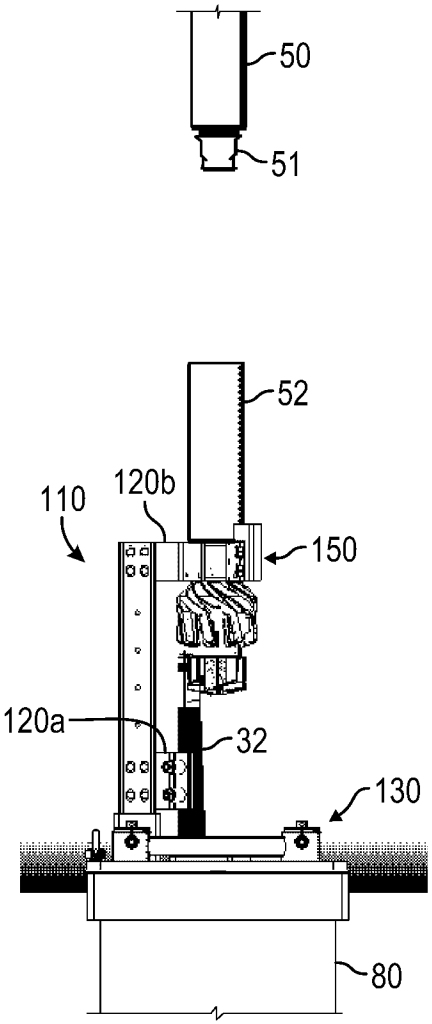
Figure 19A:
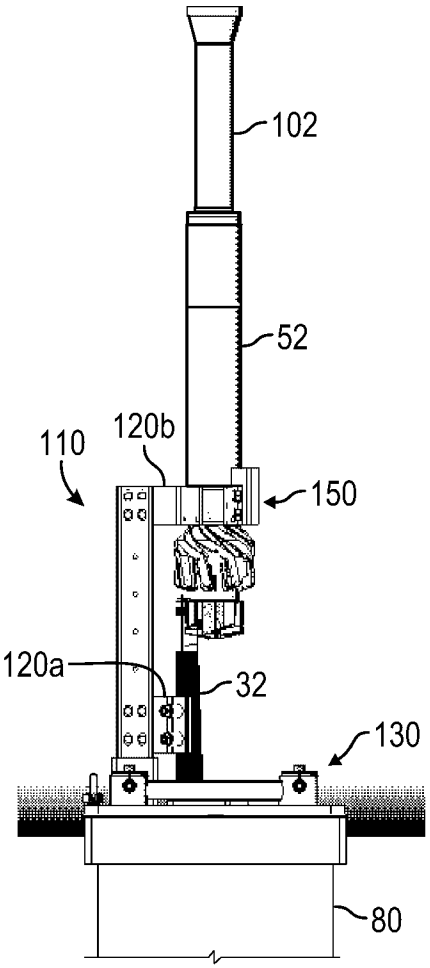

Now as shown in FIGS. 19A-19C, the lifting sub 102 is disconnected from the lead mill 52. Operators pick up the milling assembly 50 utilizing its attached lifting sub. A thread protector is removed, and pipe dope is applied to threads on the coupling 51. The coupling 51 is then stabbed into the lead mill 52 supported by the mill support member 110 on the base member 130. The connection between the milling assembly 50 and the lead mill 52 is then torqued using an Iron Roughneck (not shown).

Figure 20A:
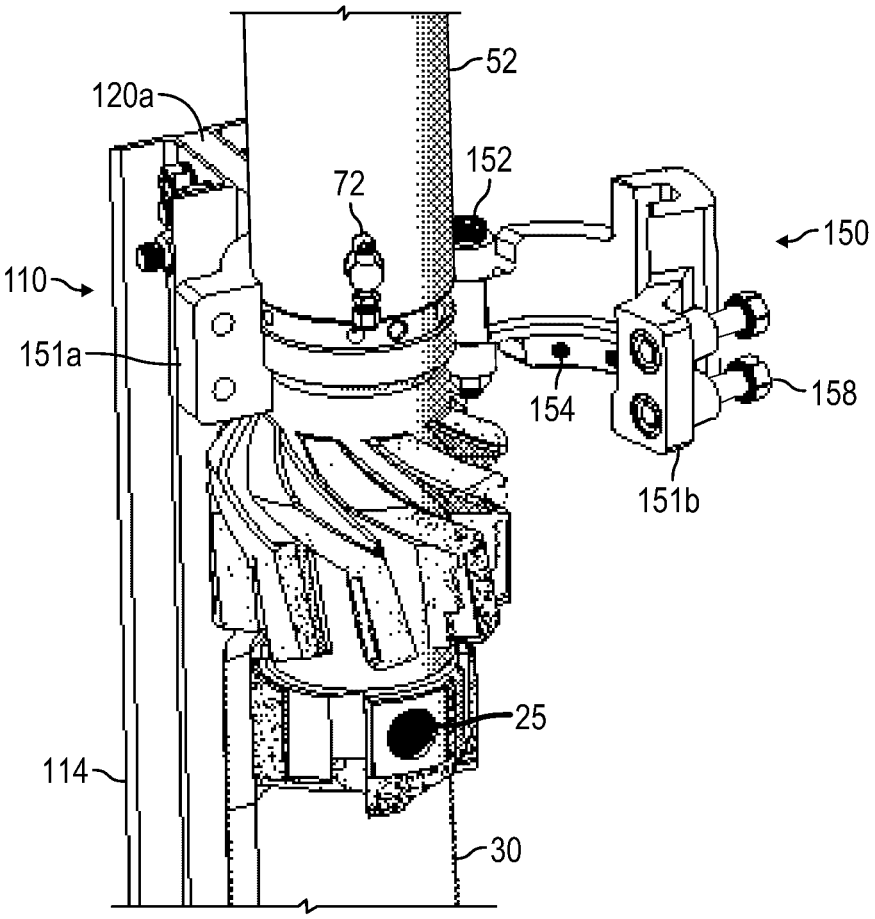
FIGS. 20A-20C illustrate steps for disconnecting the mill support from the lead mill, the whipstock assembly, and the base assembly.
Figure 20C:
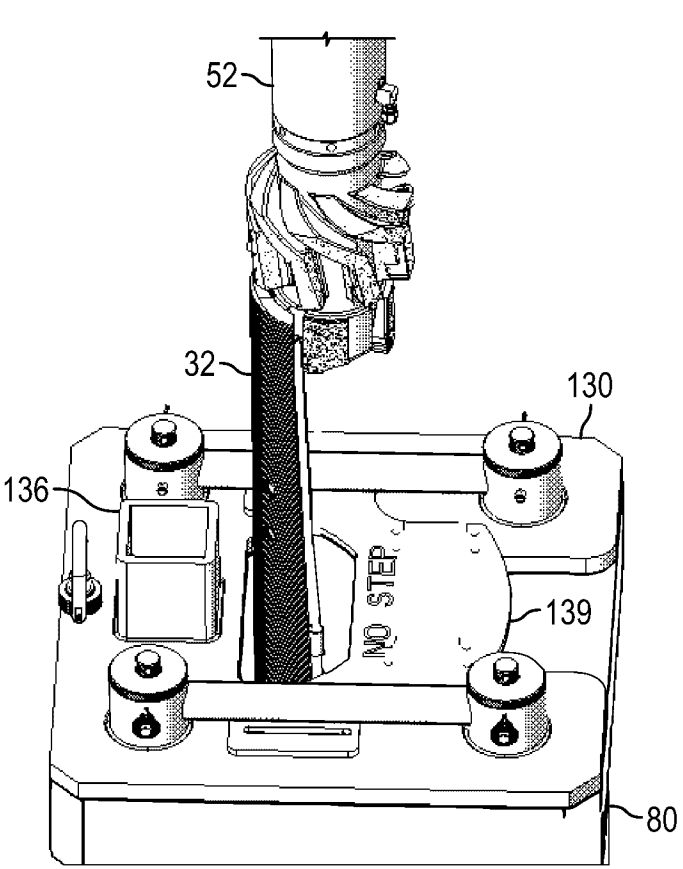
Figure 20B:
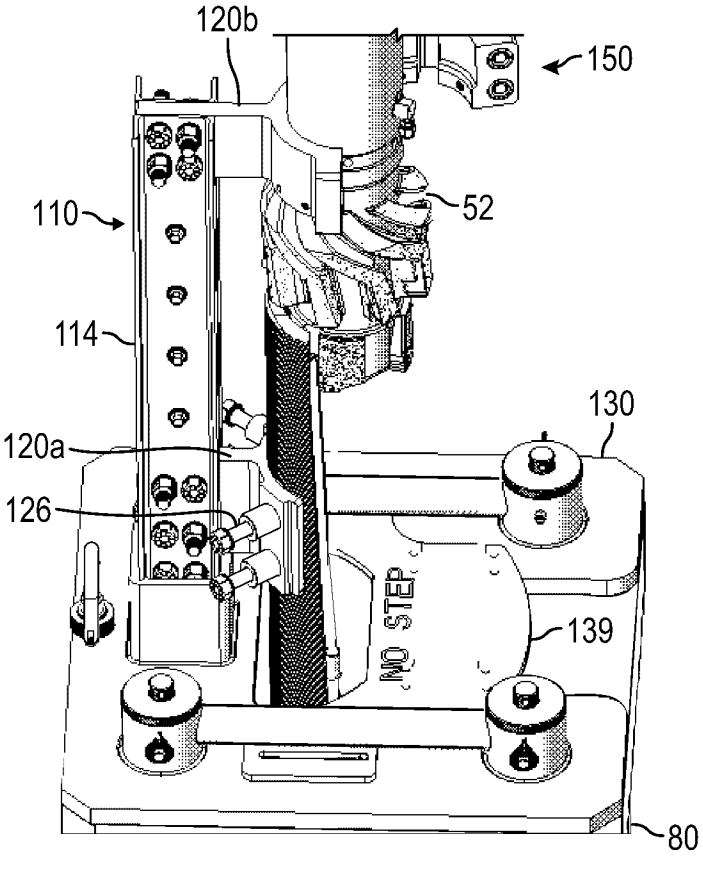

Operators now use the rig to pick up slightly on the work string connected to the bottom hole assembly having the milling assembly 50 and whipstock assembly 30 to ensure that weight is fully supported by the rigs draw works and to ensure that the mill support member 110 is unloaded. As shown in FIG. 20A, the clamp fasteners 158 are loosened on the clamp assembly 150 of the mill mount 120*b*, and the hinged clamp assembly 150 is opened. As shown in FIG. 20B, the fasteners 126 in the whip mount 120*a* are loosened. Ultimately, the mill support member 110 can be removed and set aside as shown in FIG. 20C.

Figure 21A:
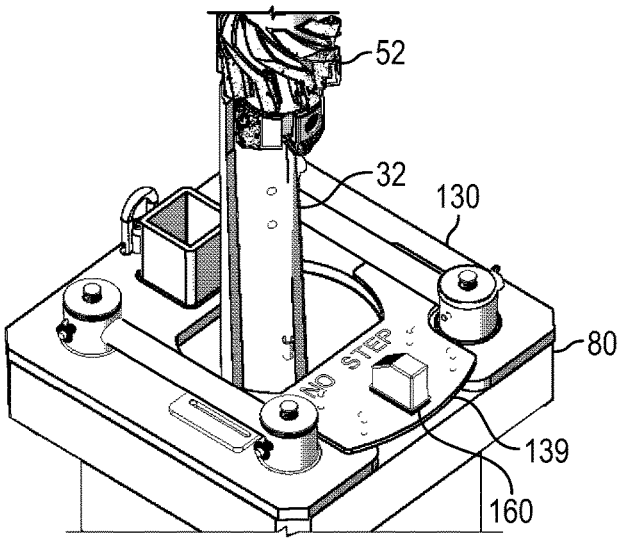
FIGS. 21A-21B illustrate steps for deploying the whipstock assembly and connected milling assembly.

As shown in FIG. 21A, the man saver 139 is retracted, and an alignment laser 160 is positioned on the man saver 139 for marking an orientation line along the drill string. While the laser 160 is activated, the drill string is lowered until reaching an MWD reference point on the bottom hole assembly (20). Operators measure the offset between the MWD reference and the BHA's orientation. As will be appreciated, this offset is used when orienting the whipstock assembly 30 for use downhole.

Figure 21B:
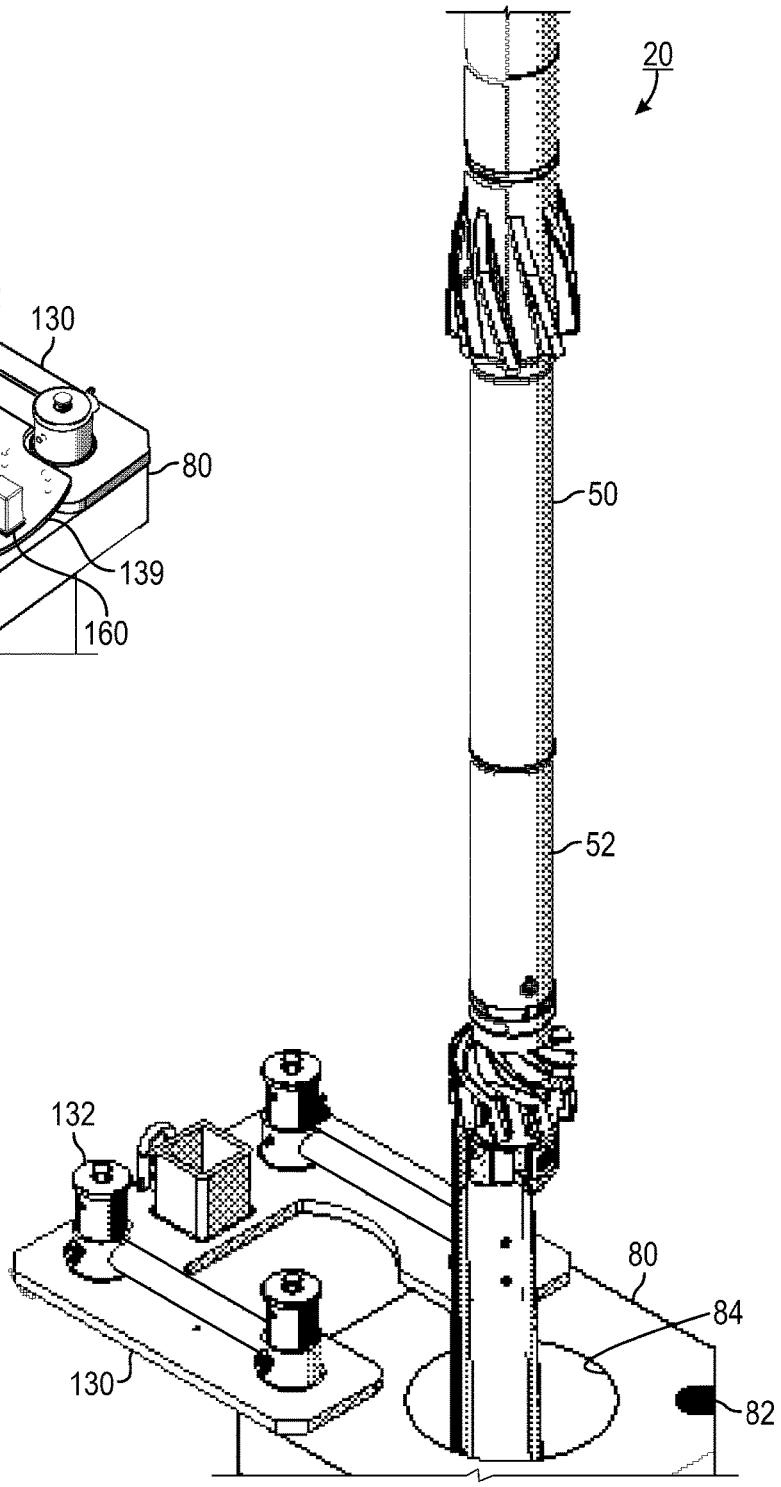

After recording orientation data for the MWD reference, the man saver 139 and laser 160 are removed, as shown in FIG. 21B. The drive pins 132 are retracted, and the base member 130 is set aside. The work string and bottom hole assembly (20) can now be tripped into hole and can be used to mill a window for a sidetrack in accordance with typical operations.

Figure 22A:
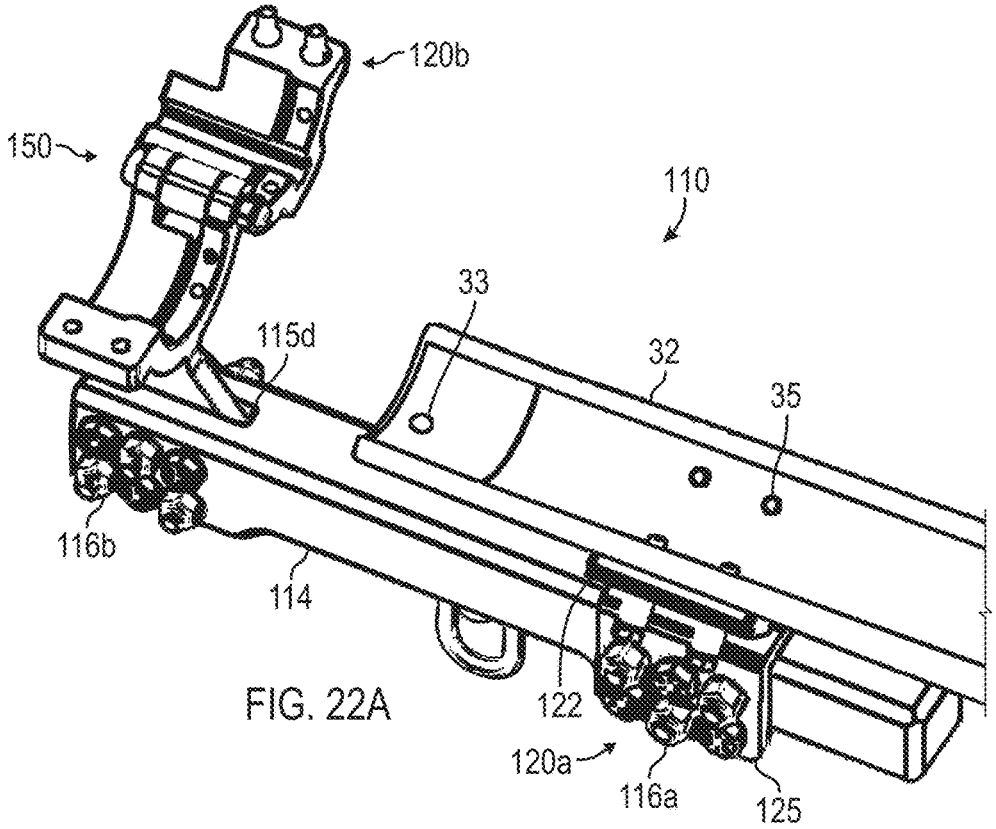
FIGS. 22A-22D illustrate various views of another implementation of the disclosed apparatus.

FIGS. 22A-22D illustrate various views of another implementation of the disclosed apparatus. FIG. 22A shows a perspective view of a first component or mill support member 110 similar to that discussed previously with reference to FIG. 12. The mill support member 110 includes a support beam 114 having a whip mount 120*a* and a mill mount 120*b*.

As shown, the support beam 114 can include a unitary beam. The whip mount 120*a* has a flange 122 and a bracket 125. The bracket 125 fits about the support beam 114 and affixes with fasteners 116*a*. The mill mount 120*b* has a clamp assembly 150, and an end of the mill mount 120*b* positions in a slot 115*d* in the support beam 114. The mill mount 120*b* is affixed with fasteners 116*b* to the support beam 114. These features provide a modular arrangement to the components of the mill support member 110. Different lengths of the support beam 114 can be used with existing mounts 120*a-b* to configure the support member 110 for different implementations. Additionally, different sized or configured mounts can be used with the support beam 114 to meet the needs of given implementations. Overall, the mill support member 110 can be designed to meet required sizing needs and strength requirements.

Figure 22B:
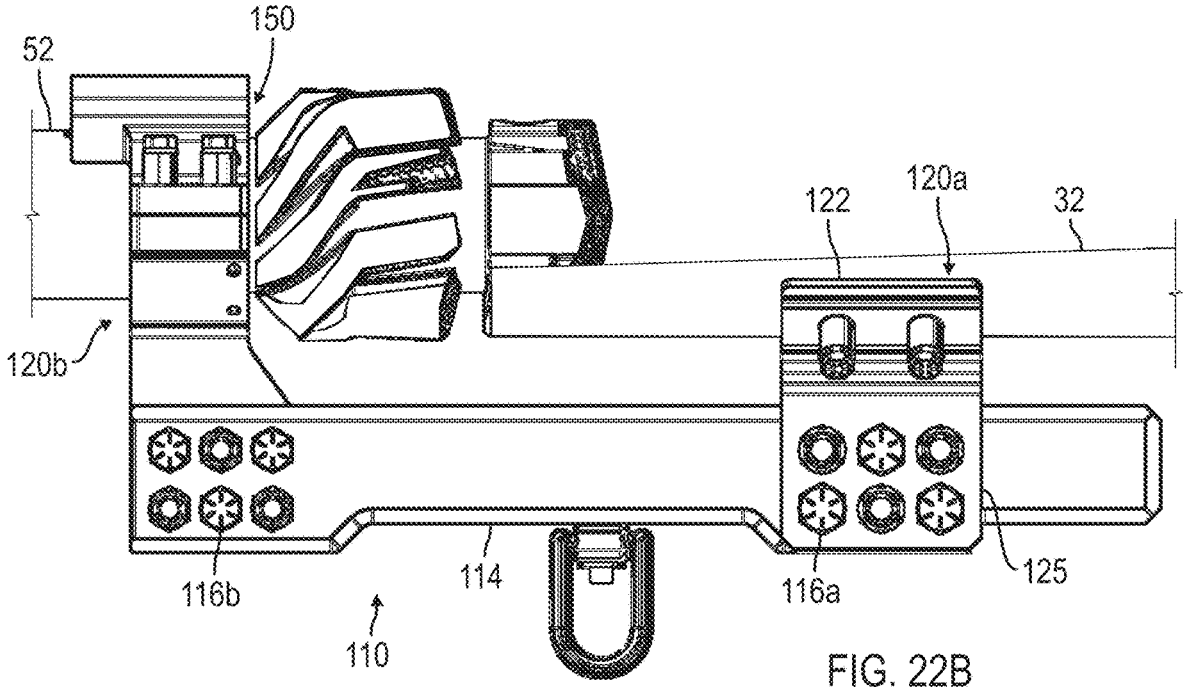

As shown in FIG. 22B and similar to what is discussed previously, the mill support member 110 removably supports the whipstock 32 and the lead mill 52, which are connected by the releasable operational connection (25). Again, the flange 122 of the whip mount 120*a* is configured to releasably engage a portion of the whipstock 32, and the clamp assembly 150 of the mill mount 120*b* is configured to releasably engage a portion of the lead mill 52 in a manner similar to that discussed above with reference to FIG. 15A. During assembly in a workshop, the whipstock 32 is affixed to the flange 122 of the whip mount 120*a* with torqued fasteners as before. The fasteners 116*a* on the bracket 125 are loosened. Similarly, the fasteners 116*b* for the mill mount 120*b* are loosened. The lead mill 52 is lowered by a lifting sling onto the open clamp assembly 150 of the mill mount 120*b*. The releasable operational connection (25) is made up between the lead mill 52 and the whipstock 32. The clamp assembly 150 is closed, and its fasteners are hand tightened.

Figure 22C:
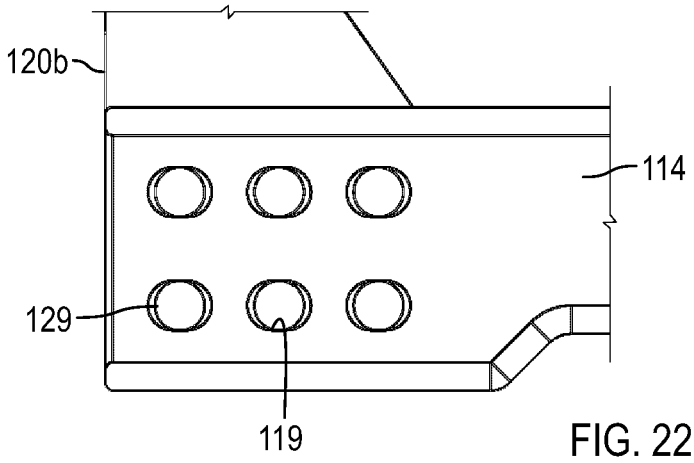

The mill mount 120*b* is then pulled to ensure that the clamp's shoulder is firmly engaged with upset on the neck of the lead mill 52. As shown in the detail of FIG. 22C, the mill mount 120*b* inserted in the slot 115*d* at the end of the beam 114 has elongated slots 129. The support beam 114 also has elongated slots 119. These elongated slots 119, 129 allow for adjustments to compensate for manufacturing dimensional tolerances. Once the clamp assembly 150 and lead mill 52 are shouldered, the fasteners for the clamp assembly 150 are tightened, and the fasteners 116*a-b* for the mounts 120*a-b* are tightened. Other assembly steps for the mill support member 110 can be similar to those discussed previously and are not described previously.

Figure 22D:
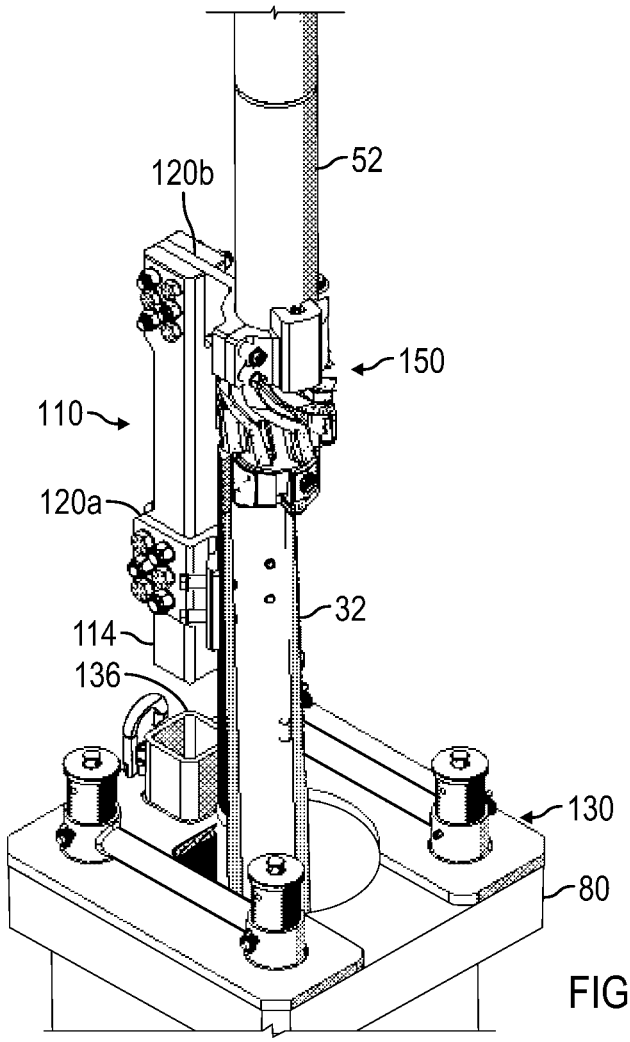

Finally, FIG. 22D shows the mill support member 110 used with a base member 130 of the apparatus. Deployment and use of these components 110, 130 can be similar to that disclosed above with reference to FIGS. 18A through 21B. Details are reincorporated herein and are not repeated.

Figure 23A:
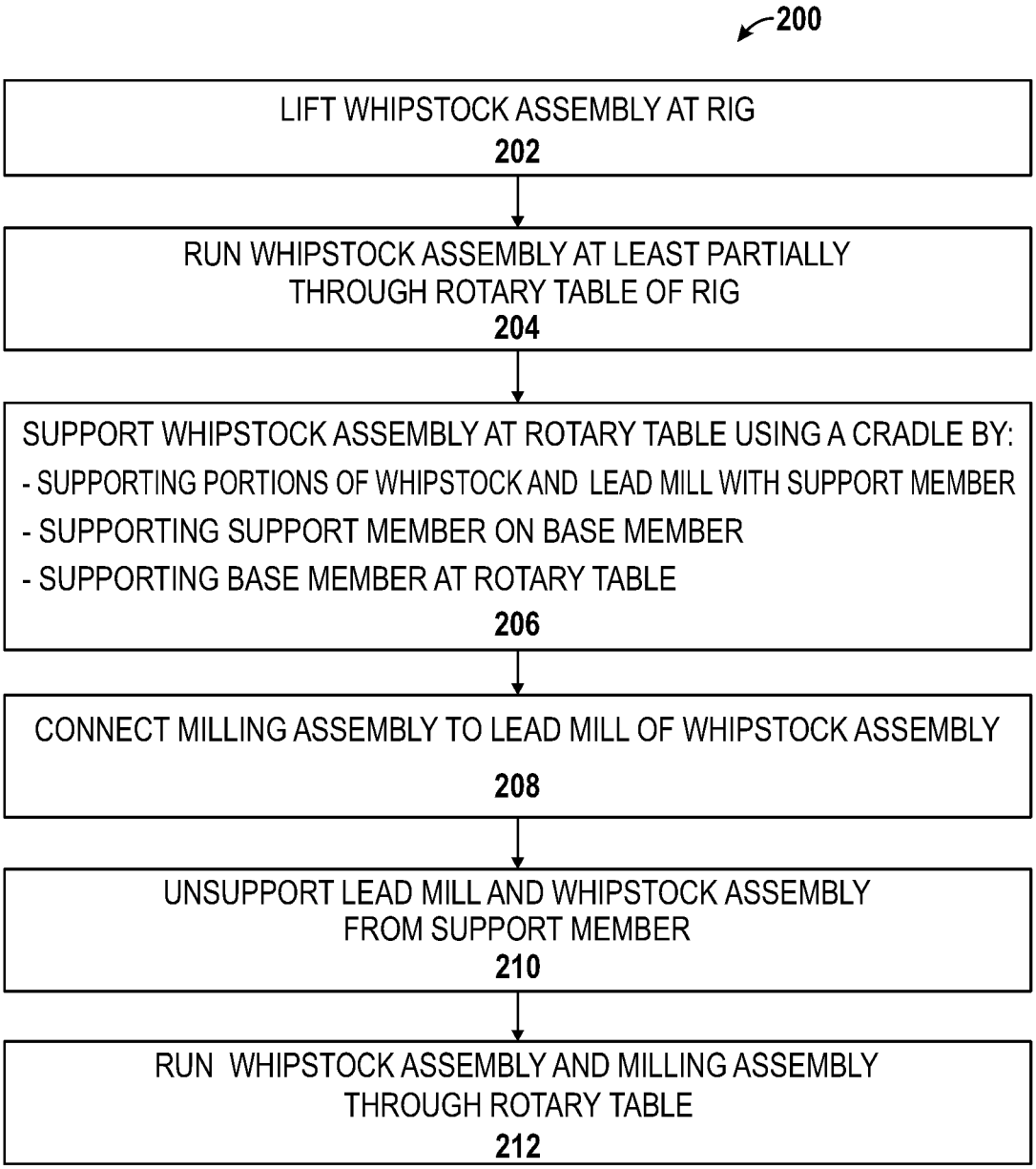
FIGS. 23A-23B are flowcharts of example processes using the apparatus of the present disclosure.

FIG. 23A is a flowchart of an example process 200. In some implementations, one or more process blocks of FIG. 23A may be performed by an apparatus 100 of the present disclosure and may be performed at a rotary table of a rig to deploy a bottom hole assembly.

As shown in FIG. 23A, the process 200 may include lifting a whipstock assembly (30) at the rig, wherein the whipstock assembly (30) has a whipstock (32) and a lead mill (52) connected together by a releasable operational connection (25) (block 202). The process 200 may include running the whipstock assembly (30) at least partially through the rotary table of the rig (block 204). The process 200 may include supporting the whipstock assembly (30) at the rotary table of the rig using a cradle (101) by: supporting portions of the whipstock (32) and the lead mill (52) with a support member (110) of the cradle (101), supporting the support member (110) on a base member (130) of the cradle (101), and supporting the base member (130) at the rotary table (block 206). The process 200 may include connecting a milling assembly (50) to the lead mill (52) of the whipstock assembly (30) (block 208). The process 200 may include unsupporting the lead mill (52) and the whipstock assembly (30) from the support member (110) (block 210). Finally, the process 200 may include running the whipstock assembly (30) and the milling assembly (50) through the rotary table (block 212).

Figure 23B:
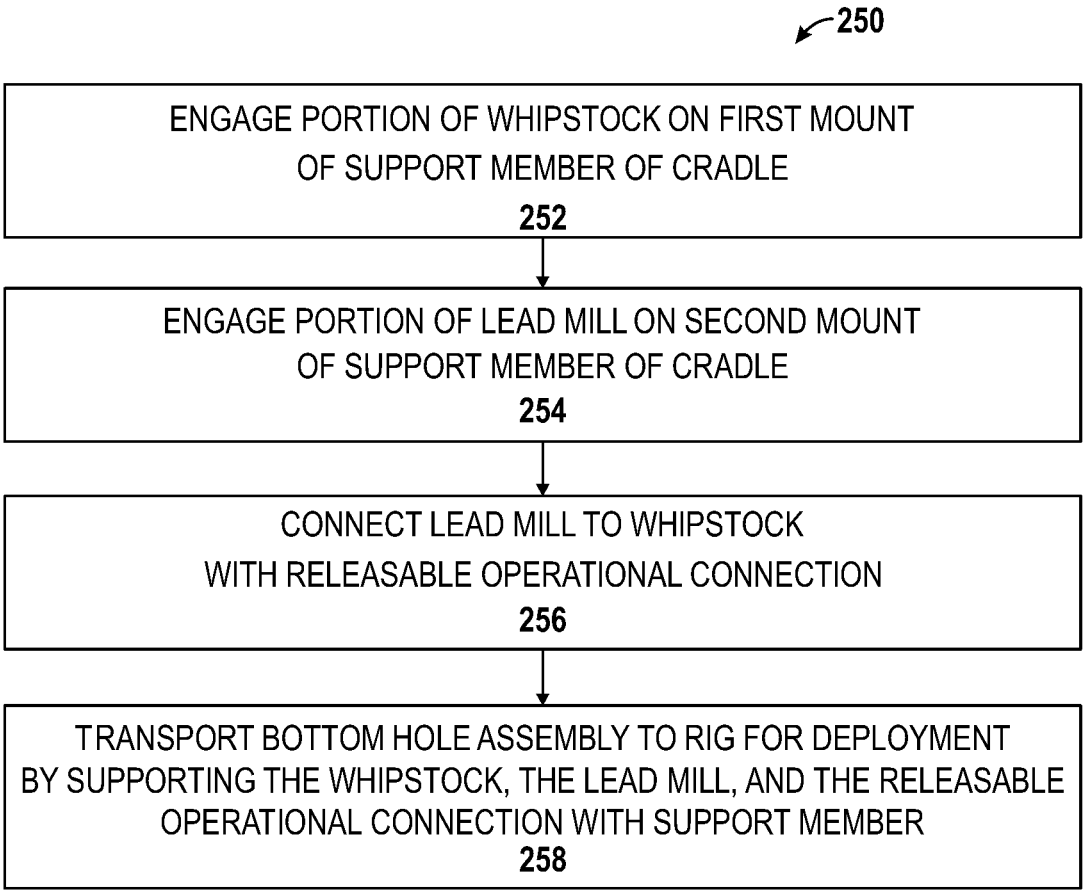

FIG. 23B is a flowchart of another example process 250. In some implementations, one or more process blocks of FIG. 23B may be performed by an apparatus 100 of the present disclosure and may be performed to assemble a bottom hole assembly for transport to a rig.

As shown in FIG. 23B, the process 250 may include engaging a portion of a whipstock (32) of the bottom hole assembly (20) on a first mount (120*a*) of a support member (110) of a cradle (101) (block 252). The process 250 may include engaging a portion of a lead mill (52) of the bottom hole assembly (20) on a second mount (120*b*) of the support member (110) of the cradle (101) (block 254). The process 250 may include connecting the lead mill (52) to the whipstock (32) with a releasable operational connection (25) (block 256). Finally, the process 250 may include transporting the bottom hole assembly (20) to the rig for deployment by supporting the whipstock (32), the lead mill (52), and the releasable operational connection (25) with the support member (110) (block 208).

Although FIGS. 23A-23B show example blocks of the processes 200 and 250, in some implementations, the processes 200 and 250 may include additional blocks, fewer blocks, different blocks, or differently arranged blocks than those depicted in FIGS. 23A-23B. Additionally, or alternatively, two or more of the blocks of the processes 200 and 250 may be performed in parallel.

As discussed in the embodiments disclosed herein, the mill support member 110 and the base member 130 can be permanently connected together, or they can be removably connected together. In another arrangement, the mill support member 110 can be a separate component from the base member 130, and the mill support member 110 can temporarily mount for support on the base member 130.

In each of these instances, the mill support member 110 supports the connection of the lead mill 52 to the whipstock 32, and the base member 130 supports the support member 110 at the rotary table.

In any of these instances, the base member 130 may not separately engage the whipstock 32. Alternatively, the base member 130 can have a shoulder to engage and support the whipstock 32. For example, a shoulder (e.g., at 135': FIG. 13A) can be provided on the base member 130 adjacent the central opening 135 to engage a complementary shoulder on the whipstock 32 to support the whipstock 32 at least temporarily suspended from the base member 130. Such a shoulder (135') on the base member 130 can be removed to disengage from the whipstock 32, or the whipstock 32 may be moved in the central opening 135 to disengage from such a shoulder (135').

Finally, as noted above, any one of the embodiments disclosed herein for the apparatus can include the option of a body support for the cradle.

The foregoing description of arrangements is not intended to limit or restrict the scope or applicability of the inventive concepts conceived of by the Applicants. It will be appreciated with the benefit of the present disclosure that features described above in accordance with any arrangement or aspect of the disclosed subject matter can be utilized, either alone or in combination, with any other described feature, in any other arrangement or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method performed at a rotary table of a rig, the method comprising the steps of:

lifting a whipstock assembly at the rig by engaging a component of the rig on a removable portion of the whipstock assembly, the whipstock assembly having a whipstock and a lead mill connected together by a releasable operational connection;

running the whipstock assembly at least partially through the rotary table of the rig;

supporting the whipstock assembly at the rotary table of the rig using an apparatus by: supporting portions of the whipstock and the lead mill with a support member of the apparatus, supporting the support member on a base member of the apparatus, and supporting the base member at the rotary table;

connecting a milling assembly to the lead mill of the whipstock assembly by removing the removable portion from the whipstock assembly and threading the milling assembly to the lead mill on the whipstock assembly;

unsporting the lead mill and the whipstock assembly from the support member; and running the whipstock assembly and the milling assembly through the rotary table.

2. The method of claim 1, wherein lifting the whipstock assembly and running the whipstock assembly at least partially through the rotary table of the rig by engaging the component of the rig on the removable portion of the whipstock assembly comprises engaging an elevator of the rig on a lifting sub connected to the lead mill on the whipstock assembly; and wherein connecting the milling assembly to the lead mill of the whipstock assembly by removing the removable portion and threading a coupling of the milling assembly to the lead mill on the whipstock assembly comprises removing the lifting sub from the lead mill and threading a coupling of the milling assembly to the lead mill.

3. The method of claim 1, wherein supporting the base member of the apparatus at the rotary table comprises engaging drive pins on the base member in slots of a drive bushing of the rotary table.

4. The method of claim 1, wherein the apparatus comprises a body support member configured to supporting a body of the whipstock and being removably connected to the base member, the method comprising, before lifting, disconnecting the body support member from the apparatus, and removing the body support member from supporting the body of the whipstock.

5. The method of claim 1, wherein the steps of lifting the whipstock assembly, running the whipstock assembly at least partially through the rotary table of the rig, supporting the support member on the base member, and supporting the base member at the rotary table comprise:

lifting the whipstock assembly having the apparatus supported thereon, the apparatus having the support member connected to the base member;

running the whipstock assembly at least partially through the rotary table of the rig; and landing the base member of the apparatus at the rotary table.

6. The method of claim 1, wherein the steps of lifting the whipstock assembly, running the whipstock assembly at least partially through the rotary table of the rig, supporting the support member on the base member, and supporting the base member at the rotary table comprise:

lifting the whipstock assembly having the support member of the apparatus supported thereon;

separately placing the base member at the rotary table;

running the whipstock assembly at least partially through the base member placed at the rotary table of the rig; and landing the support member on the base member.

7. The method of claim 6, wherein landing the support member on the base member comprises inserting an end of the support member in a receptacle disposed on the base member.

8. The method of claim 1, wherein supporting the whipstock assembly on the rig using the apparatus comprises at least one of:

engaging the whipstock on a support shoulder of the support member;

engaging the whipstock on a base shoulder of the base member; and engaging the lead mill on a clamp shoulder of a clamp.

9. The method of claim 1, wherein unsupporting the lead mill and the whipstock assembly from the support member comprises at least one of:

disconnecting the whipstock assembly from the support member;

unfastening a first mount on the support member from the whipstock;

removing a second mount of the support member from the lead mill; and unclamping a clamp on the second mount of the support member from the lead mill.

10. The method of claim 1, wherein before running the whipstock assembly and the milling assembly through the rotary table, the method comprises marking an orientation of the whipstock assembly relative to the milling assembly.

11. A method of assembling a bottom hole assembly for transport to a rig, the method comprising:

engaging a portion of a whipstock of the bottom hole assembly on a first mount of a support member of an apparatus;

engaging a portion of a lead mill of the bottom hole assembly on a second mount of the support member of the apparatus;

connecting the lead mill to the whipstock with a releasable operational connection; and supporting the whipstock, the lead mill, and the releasable operational connection with the support member for transportation of the bottom hole assembly to the rig for deployment.

12. An apparatus used for transporting a bottom hole assembly to a rig and used for supporting the bottom hole assembly at a rotary table of the rig, the bottom hole assembly having a whipstock and a lead mill, the lead mill and the whipstock being connected together by a releasable operational connection, the apparatus comprising:

a support member removably supporting the releasable operational connection between the whipstock and the lead mill, the support member having first and second mounts, the first mount configured to releasably engage a portion of the whipstock, the second mount configured to releasably engage a portion of the lead mill; and a base member being configured to be positioned at the rotary table of the rig with an end of the whipstock extending through the base member, the base member being configured to support the support member.

13. The apparatus of claim 12, wherein to releasably engage the portion of the whipstock, the first mount comprises at least one of:

a first flange configured to affix with a fastener to a side of the whipstock; and a second flange having a shoulder configured to vertically support a complementary shoulder on the whipstock.

14. The apparatus of claim 12, wherein to releasably engage the portion of the lead mill, the second mount comprises a flange against which a lifting sub of the lead mill positions.

15. The apparatus of claim 12, wherein to releasably engage the portion of the lead mill, the second mount comprises a clamp configured to clamp about a neck of the lead mill.

16. The apparatus of claim 15, wherein the clamp comprises at least one of:

a shoulder to support an upset in the neck of the lead mill; and a plurality of set screws threadable against the neck of the lead mill.

17. The apparatus of claim 12, wherein the base member comprises a shoulder configured to vertically support a complementary shoulder on the whipstock.

18. The apparatus of claim 12, further comprising a body member removably connected to the base member, wherein the support member, the base member, and the body member connected together are configured to support the whipstock, the lead mill, and the releasable operational connection for transporting the bottom hole assembly.

19. The apparatus of claim 12, wherein:

the support member is releasably connected to the base member as a unit, and the support member and the base member are connected together as the unit for transporting and supporting the bottom hole assembly; or the support member is a separate component from the base member, the support member is used for transporting the bottom hole assembly at the rig, the base member is supported at the rotary table of the rig, and the support member is supported by the base member for supporting the bottom hole assembly at the rig.

20. The apparatus of claim 12, wherein the base member comprises at least one of:

a receptacle configured to receive an end of the support member therein for support the bottom hole assembly at the rig;

one or more drive pins extending therefrom and configured to engage in slots of a master drive bushing in the rotary table at the rig; and one or more drive pins are removably disposed on the base member or are movable between extended and retracted conditions on the base member.

* * * * *